US006819892B2

(12) United States Patent
Nakazato et al.

(10) Patent No.: US 6,819,892 B2
(45) Date of Patent: Nov. 16, 2004

(54) ELECTROPHOTOGRAPHIC IMAGE FORMING APPARATUS INCLUDING AIR CONDITIONING MEANS FOR REMOVING HARMFUL SUBSTANCES

(75) Inventors: Yasushi Nakazato, Tokyo (JP); Yusuke Takeda, Kanagawa (JP); Tsukuru Kai, Kanagawa (JP); Satoshi Muramatsu, Kanagawa (JP); Masanori Suzuki, Shizuoka (JP); Yasuo Suzuki, Shizuoka (JP); Kazuyuki Shimada, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/268,830

(22) Filed: Oct. 11, 2002

(65) Prior Publication Data

US 2003/0086722 A1 May 8, 2003

(30) Foreign Application Priority Data

Oct. 12, 2001 (JP) ..... 2001-315737

(51) Int. Cl.[7] ..... G03G 15/00
(52) U.S. Cl. ..... 399/93; 399/94
(58) Field of Search ..... 399/93, 92, 94, 399/96

(56) References Cited

U.S. PATENT DOCUMENTS

| | | | | |
|---|---|---|---|---|
| 5,286,588 | A | 2/1994 | Suzuki | |
| 5,457,521 | A * | 10/1995 | Makiura et al. | 399/93 |
| 5,481,339 | A * | 1/1996 | De Cock et al. | 399/93 |
| 5,561,016 | A | 10/1996 | Suzuki et al. | |
| 5,578,405 | A | 11/1996 | Ikegami et al. | |
| 5,665,500 | A | 9/1997 | Suzuki | |
| 5,677,096 | A | 10/1997 | Suzuki | |
| 5,928,828 | A | 7/1999 | Suzuki | |
| 6,026,262 | A | 2/2000 | Kinoshita et al. | |
| 6,030,736 | A | 2/2000 | Ikegami et al. | |
| 6,136,483 | A | 10/2000 | Suzuki et al. | |
| 6,308,024 | B1 * | 10/2001 | Nakayama | 399/98 |
| 6,505,014 | B2 | 1/2003 | Aoki et al. | |
| 6,628,906 | B2 * | 9/2003 | Kimizuka | 399/44 |
| 2003/0091363 | A1 * | 5/2003 | Hoffman | 399/92 |

FOREIGN PATENT DOCUMENTS

| | | | |
|---|---|---|---|
| DE | 0 629 931 | * | 6/1993 |
| JP | 58-35574 | | 3/1983 |
| JP | 62-169170 | | 7/1987 |
| JP | 1-85841 | | 6/1989 |
| JP | 3-29943 | | 3/1991 |
| JP | 5-11672 | | 1/1993 |
| JP | 06-130773 | | 5/1994 |
| JP | 06-236132 | | 8/1994 |
| JP | 07-072770 | | 3/1995 |
| JP | 9-80994 | | 3/1997 |
| JP | 9-81017 | | 3/1997 |
| JP | 2000-098855 | | 4/2000 |

* cited by examiner

*Primary Examiner*—Quana Grainger
(74) *Attorney, Agent, or Firm*—Oblon, Spivak, McClelland, Maier & Neustadt, P.C.

(57) ABSTRACT

An image forming apparatus of the present invention includes a casing, an image forming unit, and an air conditioning device. The image forming unit includes a case accommodating at least a photoconductive element therein and formed with an opening for image transfer via which the photoconductive element is partly exposed to the outside. The opening is the only opening that might allow substances harmful to image formation into the case when the image forming unit is mounted to the casing. The air conditioning device removes the harmful substances flowing into the image forming unit from the outside.

124 Claims, 13 Drawing Sheets

ELECTROPHOTOGRAPHIC IMAGE FORMING APPARATUS INCLUDING AIR CONDITIONING MEANS FOR REMOVING HARMFUL SUBSTANCES

BACKGROUND OF THE INVENTION

1. Field of the Invention

The present invention relates to an electrophotographic image forming apparatus.

2. Description of the Background Art

Generally, in an electrophotographic image forming apparatus, moisture, nitric compounds, ammonia gas and other substances harmful to image formation bring about the following various problems if present around a photoconductive element.

As for moisture, charged fine grains, e.g., toner and carrier grains have their electrostatic charging conditions stabilized with a charge control agent added to high-molecular resin. The high-molecular resin, however, adsorbs moisture present in air even if subjected to processing for hydrophobicity, resulting in the variation of electric resistance, frictional resistance between the grains and fluidity. Consequently, the amount of charge to deposit on the toner grains decreases and, in turn, increases image density or otherwise effects image quality.

Nitric compounds present in air around a photoconductive element are coupled with moisture also present in air to produce nitric acid, nitrate and other ionized substances and cause them to deposit on the photoconductive element. The ionized substances accelerate the deterioration of the surface of the photoconductive element and thereby cause the surface to wear at an unexpected rate. Further, the ionized substances render the surface of the photoconductive element electrically conductive with the result that a latent image formed on the surface is blurred. Nitric compounds, which are derived from discharge for charging the surface of the photoconductive element, exist in a great amount around a charger, i.e., the image forming apparatus.

Ammonia gas present in air produces ammonium nitrate when effected by the discharge of the charger. Ammonium nitrate causes the photoconductive element to sharply deteriorate. The amount of ammonia gas in air is great around a diazo copier using ammonia.

In light of the above, to enhance the durability of the photoconductive element and therefore image quality, it is necessary to remove or reduce moisture, nitric compounds and ammonia gas around the photoconductive element. Japanese Patent Laid-Open Publication No. 7-72770, for example, discloses an electrophotographic image forming apparatus configured to remove substances harmful to image formation around a photoconductive element. The apparatus disclosed in this document removes moisture in air around a photoconductive element, ozone produced by the discharge of a charger, and paper dust also present in air. For this purpose, in such an apparatus, an air conditioning mechanism sucks air from the entire space inside the apparatus while feeding conditioned air to the same space. This air conditioning scheme, however, must cover the entire space of the apparatus and therefore makes the air conditioning mechanism bulky and expensive.

Japanese Patent Laid-Open Publication No. 6-236132, for example, teaches an electrophotographic image forming apparatus in which a hygroscopic substance is positioned in the vicinity of a photoconductive element. The hygroscopic substance lowers absolute humidity around the photoconductive element to thereby prevent nitric compounds produced by the discharge of a charger from being coupled with moisture. This apparatus, like the apparatus of Laid-Open Publication No. 7-72770, dehumidifies the entire space inside the apparatus and cannot sufficiently remove moisture around the photoconductive element because moisture relatively freely flows into the apparatus.

Technologies relating to the present invention are also disclosed in, e.g., Japanese Patent Publication No. 6-82234 and Japanese Patent Laid-Open Publication Nos. 6-130773 and 2000-98855.

SUMMARY OF THE INVENTION

It is an object of the present invention to provide an image forming apparatus capable of efficiently removing substances harmful to image formation around a photoconductive element.

An image forming apparatus of the present invention includes a casing, an image forming unit, and an air conditioning device. The image forming unit includes a case accommodating at least a photoconductive element therein and formed with an opening for image transfer via which the photoconductive element is partly exposed to the outside. The opening is the only opening that might allow substances harmful to image formation into the case when the image forming unit is mounted to the casing. The air conditioning device removes the harmful substances flowing into the image forming unit from the outside.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
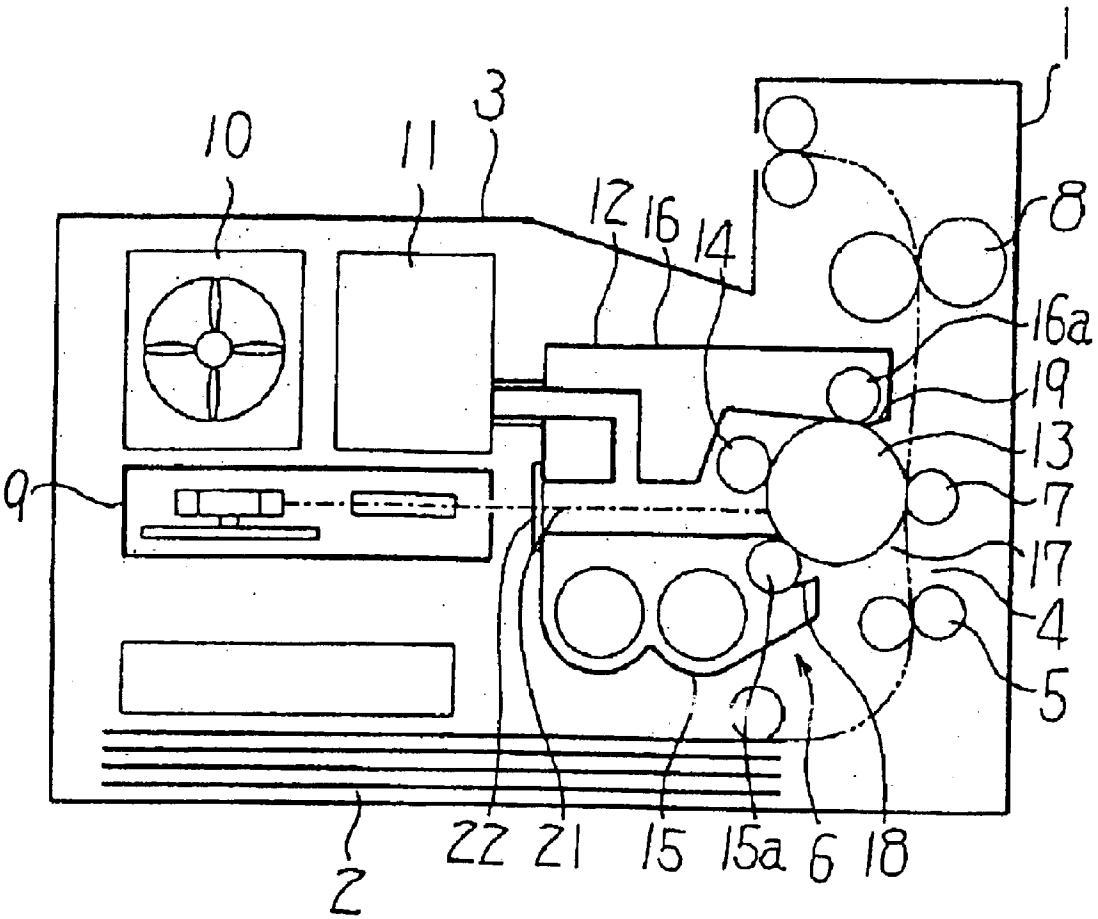
FIG. 1 is a vertical section showing a first embodiment of the electrophotographic image forming apparatus in accordance with the present invention.

Referring to FIGS. 1 through 5, a first embodiment of the electrophotographic image forming apparatus in accordance with the present invention is shown. As shown, the image forming apparatus includes a casing 1 in which a sheet path 4 extends from a sheet feed section 2 to a sheet discharge section 3. A registration roller pair 5, an image forming unit 6, an image transferring unit 7, a fixing unit 8 are arranged on the sheet path 4. Optical writing means 9, exhausting means 10 and air conditioning means 11 are also arranged in the casing 1. The optical writing means 9 scans a photoconductive element, which will be described later, with a laser beam in accordance with image data to thereby form a latent image on the photoconductive element. The exhausting means exhausts the casing 1 while the air conditioning means 11 removes substances harmful to image formation from air flowing into the image forming unit 6 from the outside of the casing 1.

The image forming unit 6 includes a case 12 accommodating a photoconductive element 13, a charger 14, a developing unit 15, a cleaning unit 16 and other processing means. In the illustrative embodiment, the photoconductive element 13 is implemented as a drum. The case 12 is formed only with an opening 17 via which the drum 13 is partly exposed to the outside. The opening 17 might allow substances harmful to image formation into the image forming unit 6.

A sleeve 15*a* is positioned at the upstream side of the opening 17 in the direction of rotation of the drum 13 and held in contact with the drum 13. The sleeve 15*a* constitutes contact type developing means, which forms part of the developing unit 15. A cleaning roller 16*a* is positioned at the downstream side of the opening 17 in the above direction and held in contact with the drum 13. The cleaning roller 16*a* serves as contact type cleaning means, which forms part of the cleaning unit 16.

A collection seal 18, an inlet seal 19 and seal members 20 (see FIG. 3) are fitted on the edges of the opening 17. The collection seal 18 is held in contact with the circumference of the sleeve 15*a* while the inlet seal 19 is held in contact with the circumference of the cleaning roller 16*a*. The seal members 20 are positioned at opposite ends of the opening 17 in the direction of length of the opening 17 in order to seal clearances between the opening 17 and the drum 13.

A slit 21 is formed in the case 12 for passing the laser beam issuing from the optical writing means 9 therethrough. The slit 21 is covered with a transparent member 22 formed of, e.g., glass or resin.

Figure 4:
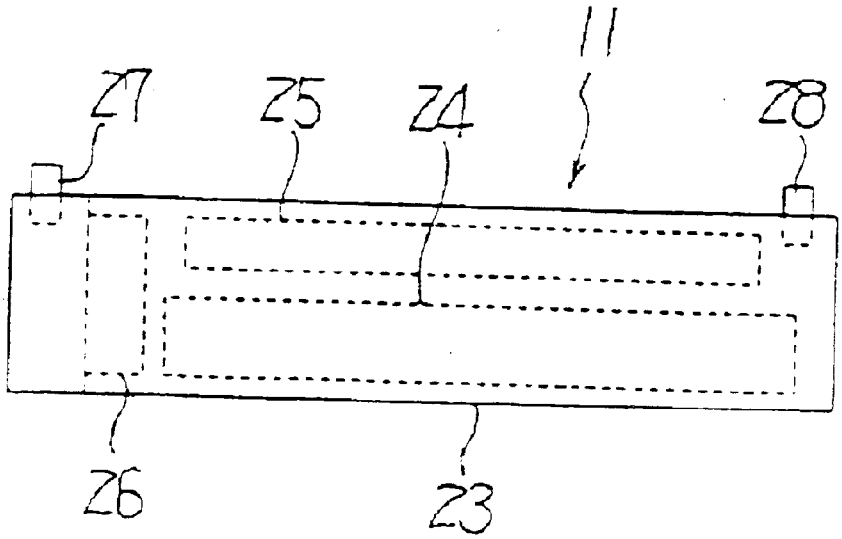
FIG. 4 is a view showing air conditioning means included in the first embodiment.

As shown in FIG. 4 specifically, the air conditioning means 11 includes a case 23 accommodating an optical catalyst 24, ultraviolet emitting means 25 for activating the catalysts 24, and a pump 26. A suction port 27 is formed in the case 23 for sucking the air into the case 23 when the pump 26 is driven. An exhaust port 28 is also formed in the case 23 for exhausting the case 23 when the pump 26 is driven. The optical catalyst 24 decomposes nitric compounds present in the air and harmful to image formation.

Figure 2:
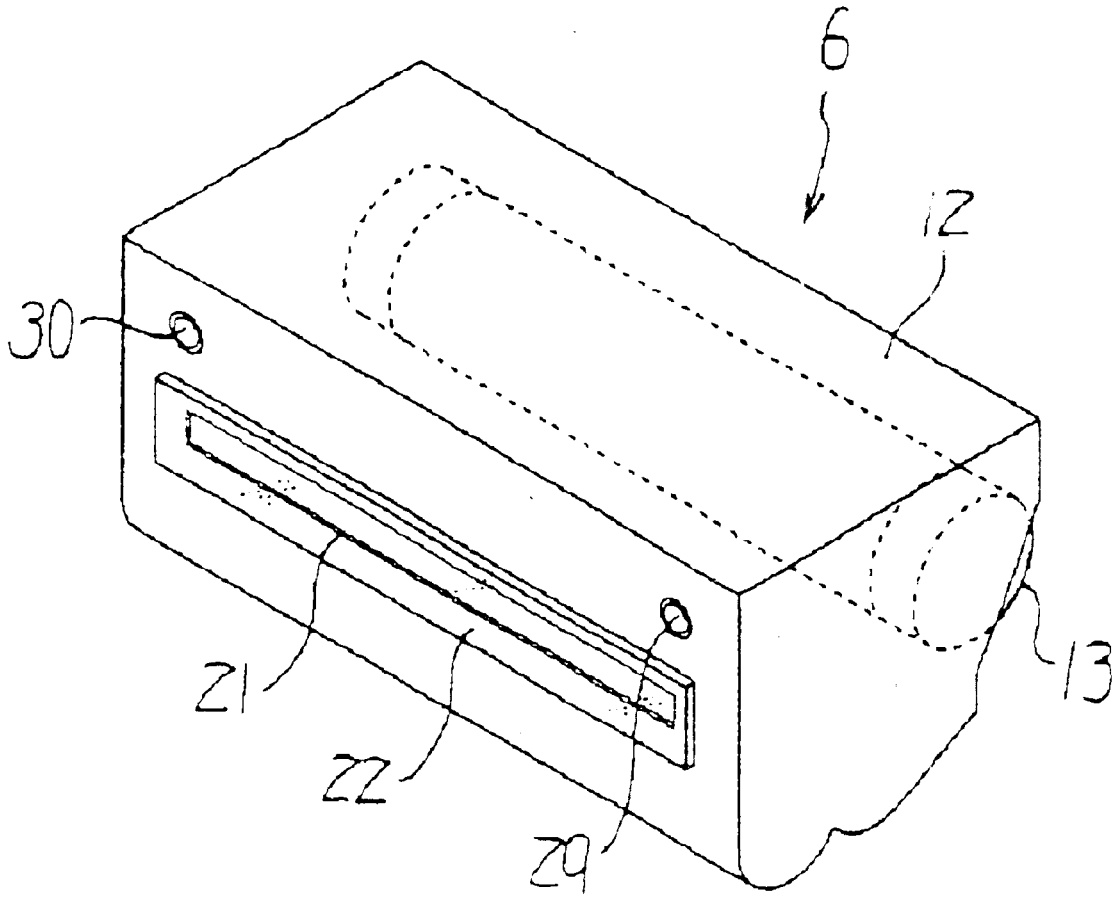
FIG. 2 is a perspective view showing an image forming unit included in the first embodiment.
Figure 3:
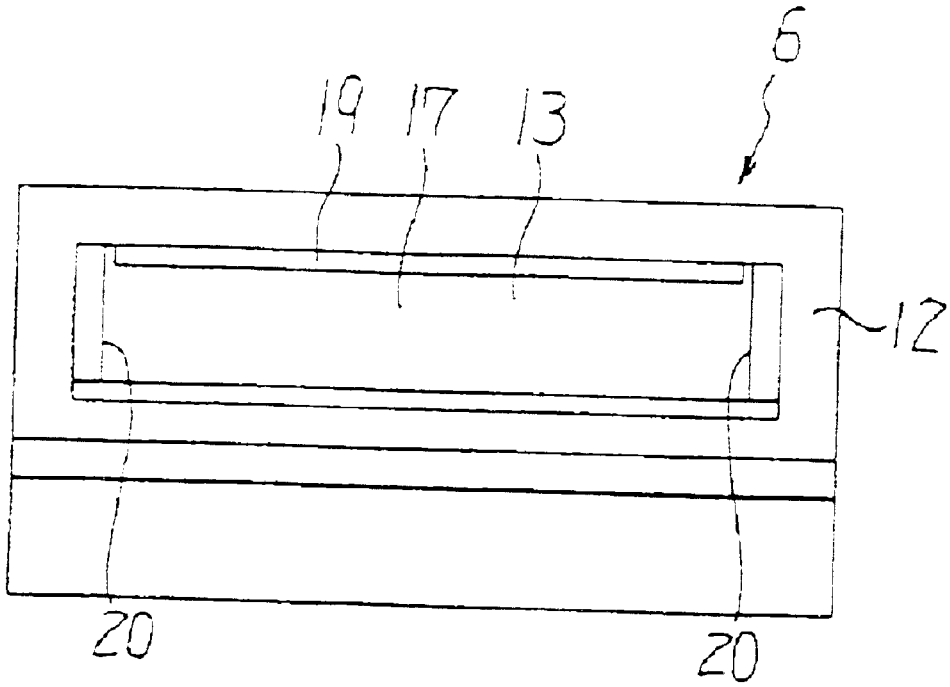
FIG. 3 is a side elevation showing the image forming unit.
Figure 5:
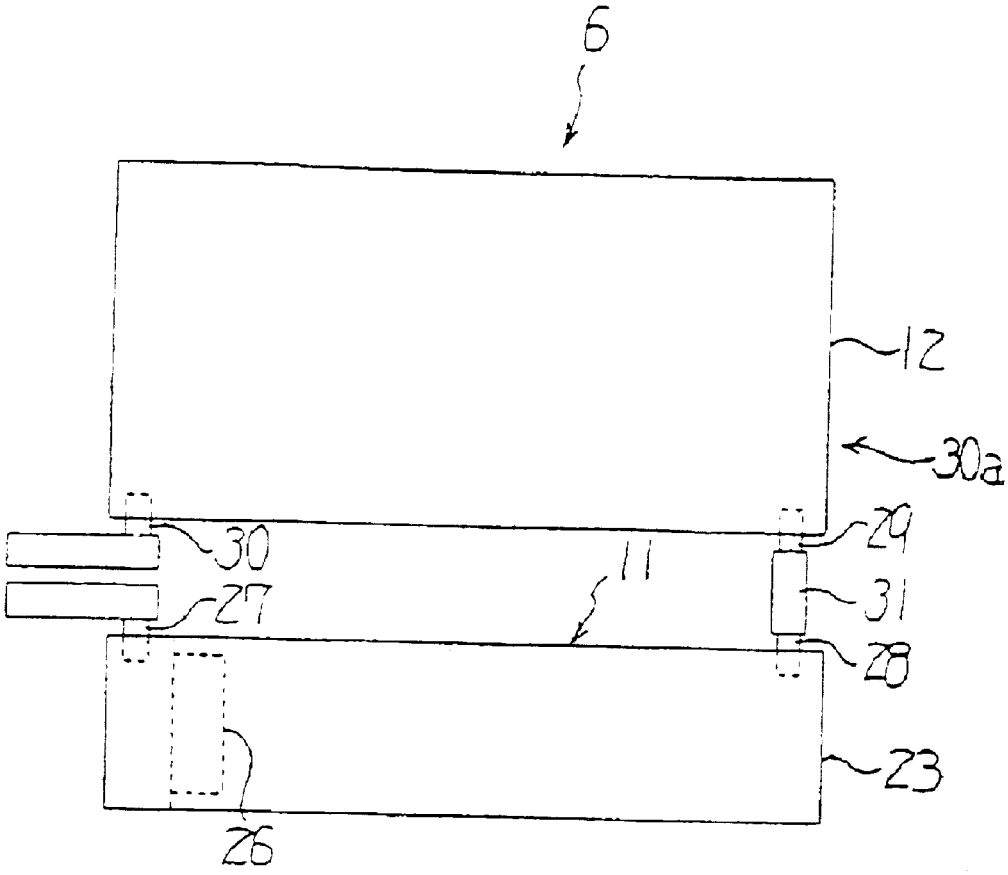
FIG. 5 is a view showing the connection of the image forming unit and air conditioning means.

As shown in FIG. 2, an inlet port 29 and an outlet port 30 are formed in the case 12 of the image forming unit 6 such that air flows into the case 12 via the inlet port 29 and flows out via the outlet port 30. As shown in FIG. 5, the inlet port 29, outlet port 30 and the space inside the image forming unit 6 form a path 30*a* providing fluid communication between the inside and the outside of the unit 6. The exhaust port 28 and inlet port 29 are connected to each other by a pipe 31, so that the air conditioning means 11 is positioned at the inlet side of the path 30*a*.

A one-way valve, not shown, is disposed in the outlet port 30 and opened only when the image forming unit 6 is to be exhausted. When exhaustion is not executed, the one-way valve is closed to prevent outside air and therefore harmful substances contained therein from entering the image forming unit via the inlet port 30.

In operation, when the pump 26 is driven, outside air is sucked into the air conditioning means 11 via the suction port 27. The optical catalyst 24 decomposes nitric compounds introduced into the air conditioning means 11 together with air. Therefore, air with no or a minimum of nitric compounds flows into the image forming unit 6 via the exhaust port 28, pipe 31, and inlet port 29 and then flows out of the image forming unit 6 via the outlet port 30.

The opening 17 is the only opening formed in the image forming unit 6 and sealed by the sleeve 15*a*, cleaning roller 16*a*, and seal members 20. This, coupled with the fact that air entered the image forming unit 6 contains no or a minimum of nitric compounds, effectively prevents nitric compounds from entering the image forming unit 6 via the opening 17; otherwise, nitric compounds would be coupled with moisture in air to produce nitric acid, nitrate and other ionized substances and would thereby bring about various problems stated earlier.

Although the charger 14 disposed in the image forming unit 6 produces nitric compounds due to discharge, such nitric compounds are entrained by the stream of air flowing through the image forming unit 6 and discharged to the outside thereby. This obviates an occurrence that the nitric compounds are coupled with moisture and deposit on the drum 13 in the form of ionized substances.

Further, the drum 13 and other processing means all are accommodated in the case 12 of the image forming unit 6, which is far smaller in capacity than the casing 1 of the apparatus. This successfully reduces the amount of air from which the air conditioning means 11 removes harmful substances, and thereby reduces the size and cost of the image forming means 11 as well as noise and power consumption.

Figure 6:
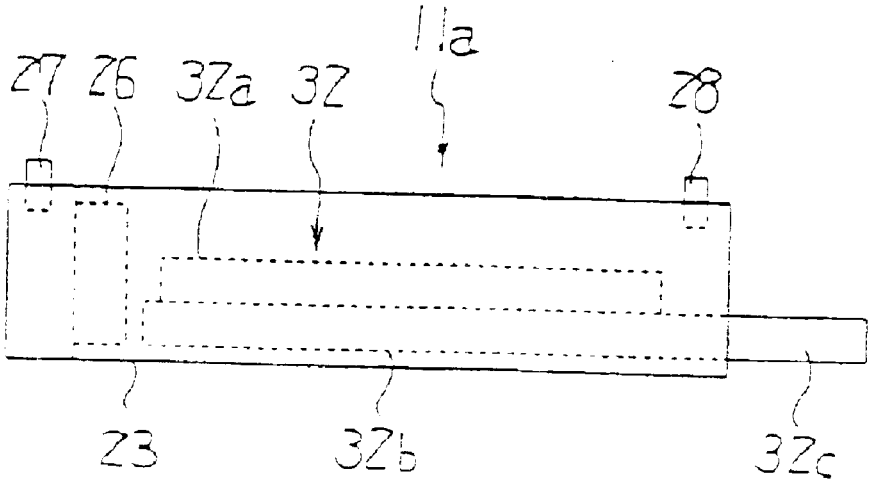
FIG. 6 is a view showing air conditioning means representative of a second embodiment of the present invention.

Reference will be made to FIG. 6 for describing a second embodiment of the present invention. In the second embodiment and other embodiments to follow, structural elements identical with the structural elements of the first embodiment are designated by identical reference numerals and will not be described specifically in order to avoid redundancy.

As shown in FIG. 6, air conditioning means 11*a* is substituted for the air conditioning means 11 of the first embodiment. As for the rest of the configuration, the second embodiment is identical with the first embodiment. As shown, the air conditioning means 11*a* includes the case 23 accommodating dehumidifying means 32 and the pump 26. The suction port 27 and exhaust port 28 are formed in the case 23. The dehumidifying means 32 is made up of cooling means 32*a* implemented by, e.g., a Peltier device and conveying means 32*b* for adsorbing and conveying dew formed by the cooling means 32*a* to the outside of the case 23. The conveying means 32*b* mainly uses capillarity and is implemented as a bundle of fibers. The portion of the conveying means 32*b* protruding to the outside of the case 23 constitutes an evaporating portion 32*c*.

The exhaust port 28 of the air conditioning means 11*a* is communicated to the inlet port 29 of the image forming unit 6 by the pipe 31, not shown, as in the first embodiment.

In operation, when the pump 26 is driven, outside air is sucked into the air conditioning means 11*a* via the suction port 27. At this instant, the dehumidifying means 32 removes moisture contained in air. Subsequently, air dehumidified and therefore lowered in absolute humidity flows into the image forming unit 6.

It is noteworthy that air entered the image forming unit 6 contains a minimum of moisture. This obviates the previously stated problems ascribable to much moisture present in air. In addition, nitric acid, nitrate and other ionized substances ascribable to the coupling of nitric compounds, if present in air inside the image forming unit 6, with moisture are reduced, so that the problems stated earlier are also obviated.

Figure 7:
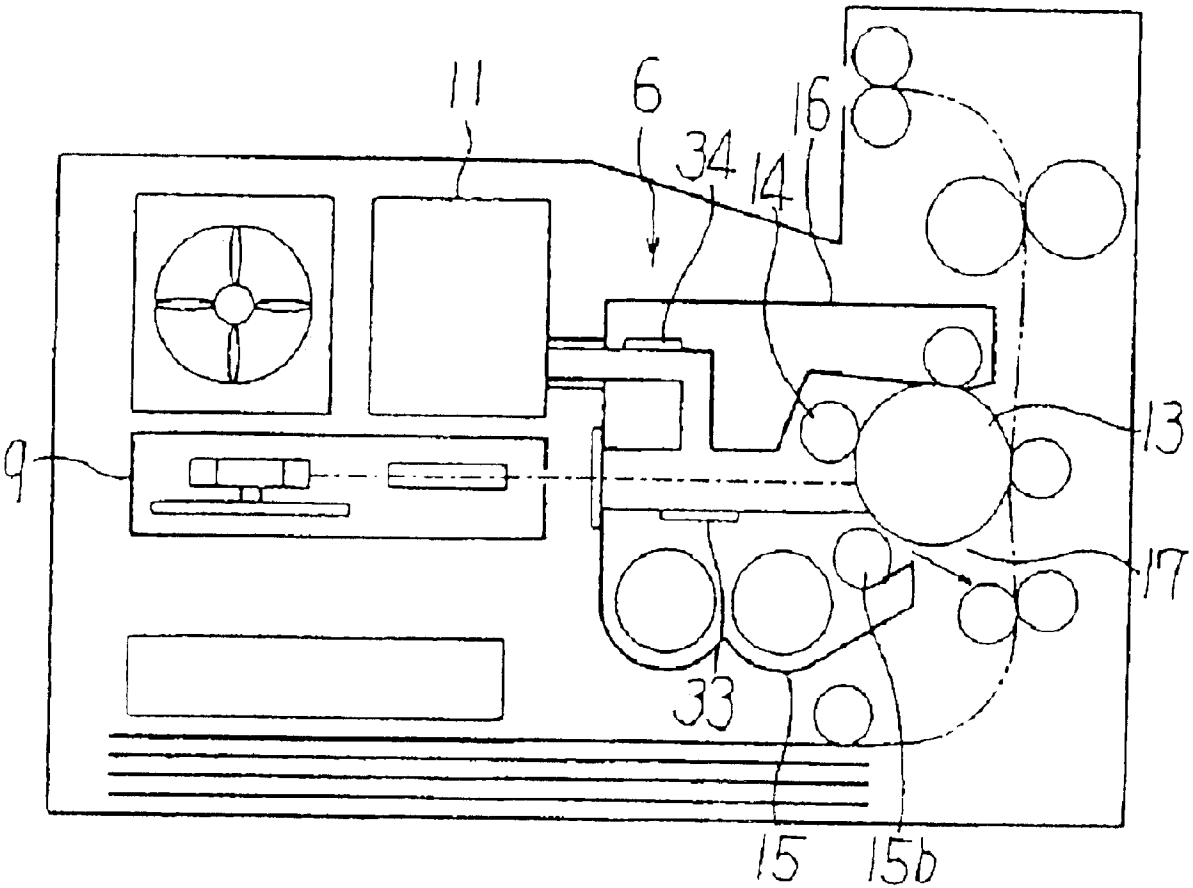
FIG. 7 is a vertical section showing a third embodiment of the present invention.
Figure 8:
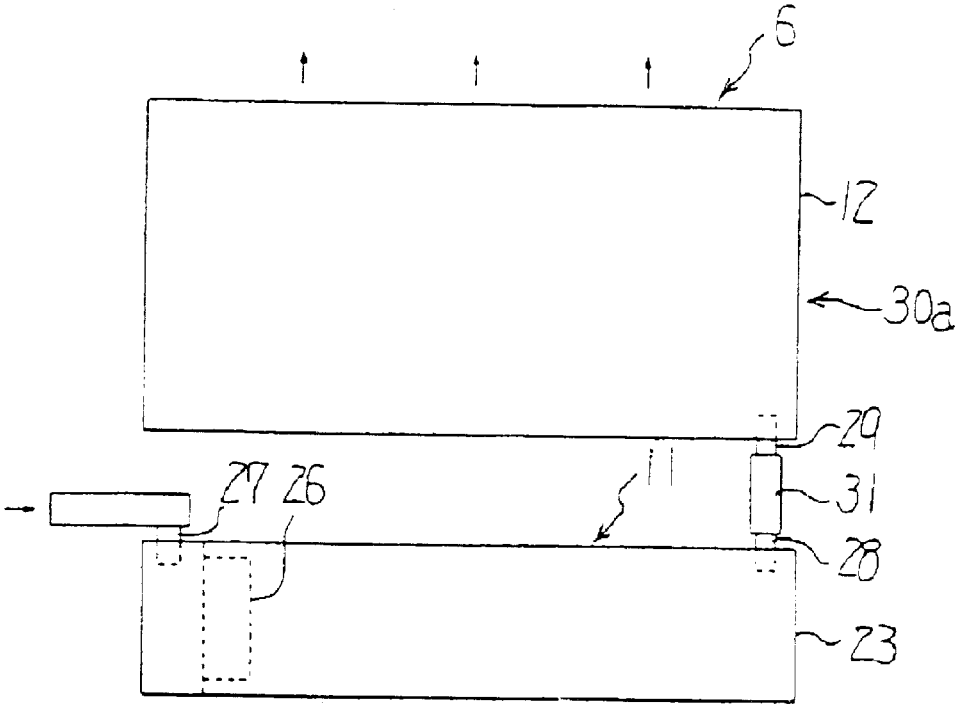
FIG. 8 is a view showing the connection of the image forming unit and air conditioning means of the third embodiment.

FIGS. 7 and 8 show a third embodiment of the present invention identical with the first embodiment except for the following. As shown, a sleeve 15*b*, which is non-contact type developing means, is substituted for the sleeve 15*a* of the first embodiment. The outlet side of the path 30*a* coincides with a gap between the sleeve 15*b* and the drum 13.

More specifically, in the illustrative embodiment, the sleeve or non-contact type developing means 15*b* is positioned at the upstream side of the opening 17, but does not contact the drum 13. The portion of the path 30*a*, which guides air fed from the air conditioning means 11 to the outside of the image forming unit, communicated to the image forming unit 6 is positioned at the gap between the sleeve 15*b* and the drum 13.

A development ventilation seal 33 is disposed in the image forming unit 6 for allowing air fed to the image forming unit 6 into the developing unit 15. Also, a cleaning ventilation seal 34 is disposed in the image forming unit 6 for allowing air fed to the image forming unit 6 into the cleaning unit 16.

In the above configuration, air introduced into the image forming unit 6 from the air conditioning means 11 is exhausted to the outside of the image forming unit 6 via the gap between the sleeve 15*b* and the drum 13. It is therefore not necessary to form an exclusive exhaust port in the case 12, so that the hermetic sealing of the image forming unit 6 is improved.

Further, air fed from the air conditioning means 11 and entered the developing unit 15 and cleaning unit 16 via the two ventilation seals 33 and 34, respectively, is free from harmful substances. This prevents moisture, nitric compounds and ammonia gas, which are harmful, from existing at the portions of the drum 13 facing the developing unit 15 and cleaning unit 16, obviating the previously stated problems more positively.

Figure 9:
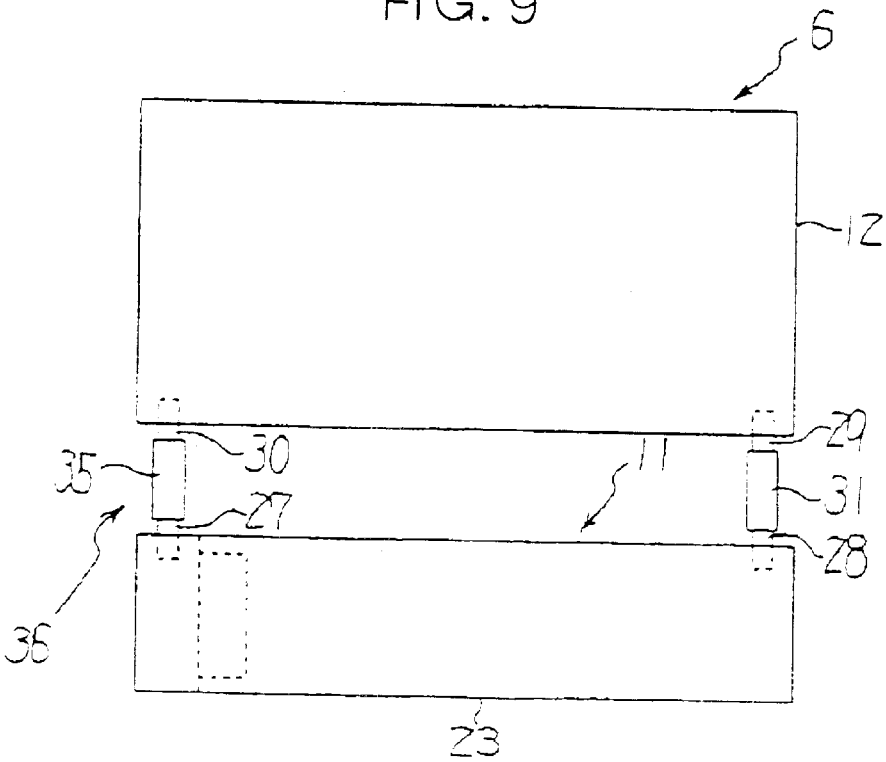
FIG. 9 shows the connection of the image forming unit and air conditioning means representative of a fourth embodiment of the present invention.

FIG. 9 shows a fourth embodiment of the present invention identical with any one of the first to third embodiments except that a circulation path 36 is substituted for the path 30*a*. As shown, the inlet port 29 of the image forming unit 6 and the exhaust port 28 of the air conditioning means 11 are interconnected by the pipe 31. In addition, the outlet port 30 of the image forming unit 6 and the suction port 27 of the air conditioning means 11 are interconnected by a pipe 35. The circulation path 36 causes air inside the image forming unit 6 to be circulated via the outlet port 30, pipe 35, suction port 27, space inside the air conditioning means 11, exhaust port 28, pipe 31, and inlet port 29.

The illustrative embodiment prevents moisture, ammonia gas and other harmful substances from entering the circulation path 36 and repeatedly removes the harmful substances from the same stream of air. This noticeably reduces the harmful substances in the image forming unit 6 to thereby further enhance the durability of the drum 13 and therefore image quality.

In the illustrative embodiment, the air conditioning means 11 is positioned on the circulation path 36 outside of the image forming unit 6. Alternatively, air conditioning means maybe disposed in the image forming unit 6 such that air inside the image forming unit 6 flows out of the unit 6 and again enters the unit 6, as will be described later in relation to a seventh embodiment of the present invention.

Figure 10:
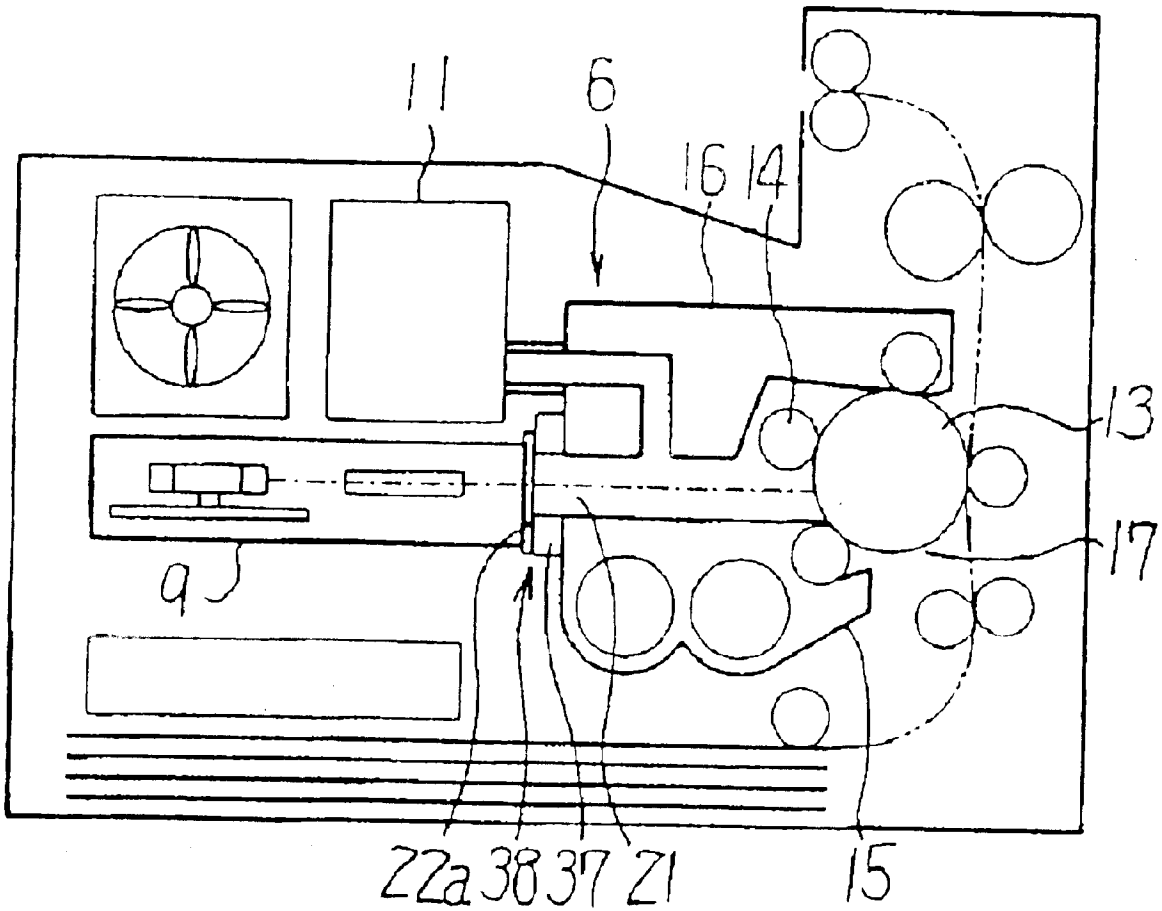
FIG. 10 is a vertical section showing a fifth embodiment of the present invention.
Figure 11:
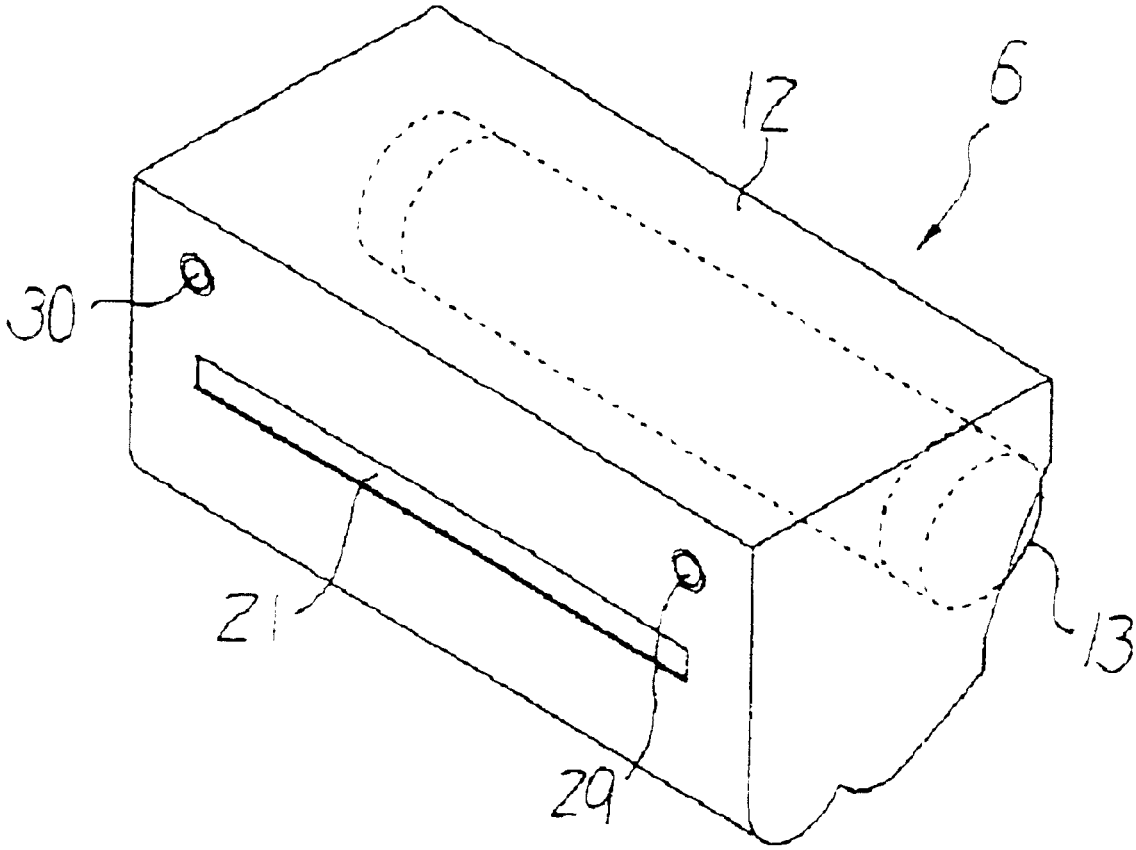
FIG. 11 is a perspective view showing the image forming unit included in the fifth embodiment.

FIGS. 10 and 11 show a fifth embodiment of the present invention identical with any one of the first to fourth embodiments except that it additionally includes closing means 38. When the image forming unit 6 is mounted to the casing 1, the closing means 38 closes the slit 21 formed in the case 12.

As shown in FIGS. 10 and 11, the closing means 38 is included in the optical writing means 9 and made up of a generally rectangular transparent member 22*a* and an elastically deformable, hermetic seal member 37 fitted on the edges of the transparent member 22*a*. The transparent member 22*a* is fixed in place in a direction in which the optical writing means 9 emits the laser beam. When the image forming unit 6 is mounted to the case 1, the seal member 37 abuts against the edges of the slit 21 to thereby close the slit 21. In this condition, harmful substances are prevented from entering the image forming unit 6 via the slit 21.

The transparent member 22*a* should transmit the laser beam and must therefore be formed of expensive glass in order to insure accurate image formation. However, in the illustrative embodiment, even when the image forming unit 6 is replaced, the expensive transparent member 22*a* does not have to be replaced. This successfully reduces the running cost of the image forming apparatus.

In an alternative arrangement, the hermetic seal member 37 is mounted on the image forming unit 6 while the transparent member 22*a* is mounted on the optical writing means 9 alone. In such a case, when the image forming unit 6 is mounted to the casing 1, the seal member 37 abuts against the edges of the transparent member 22*a* to thereby form the closing means 38.

Figure 12:
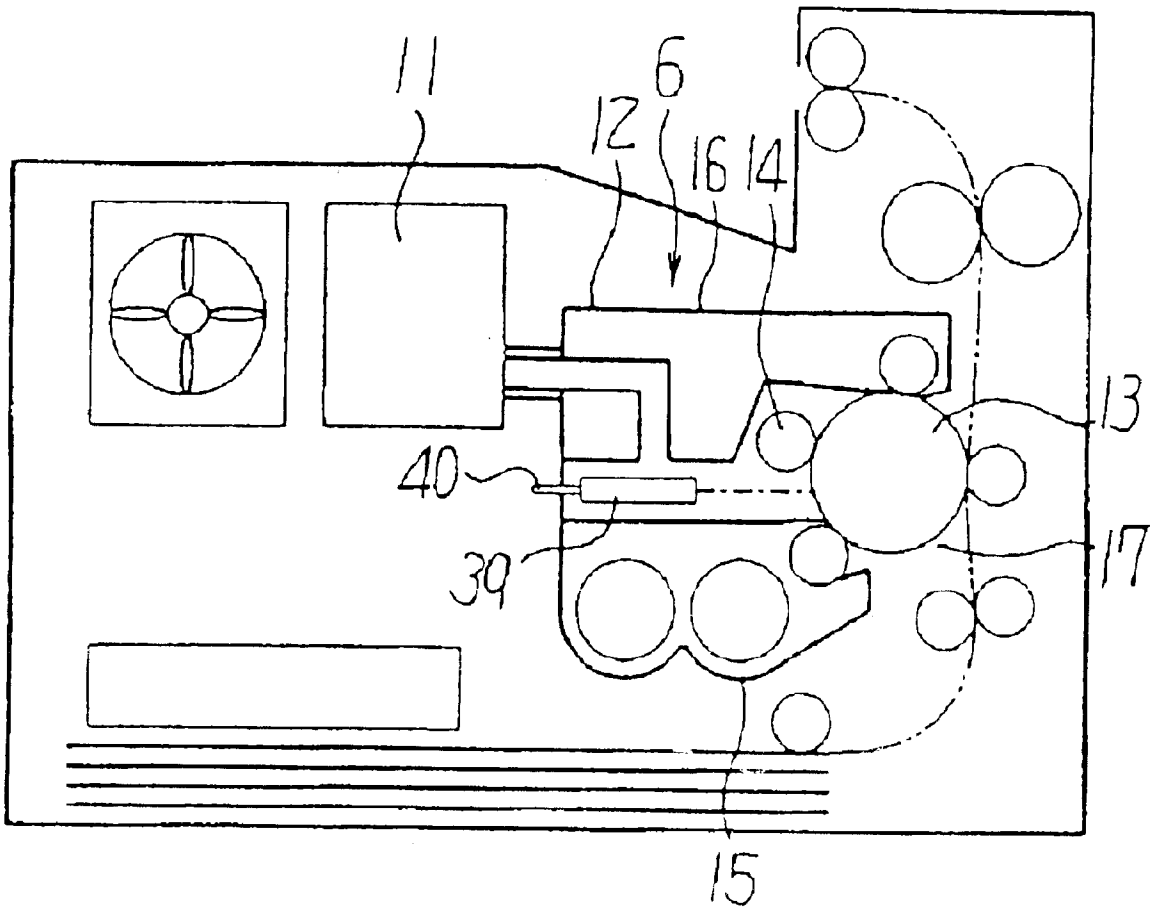
FIG. 12 is a vertical section showing a sixth embodiment of the present invention.
Figure 13:
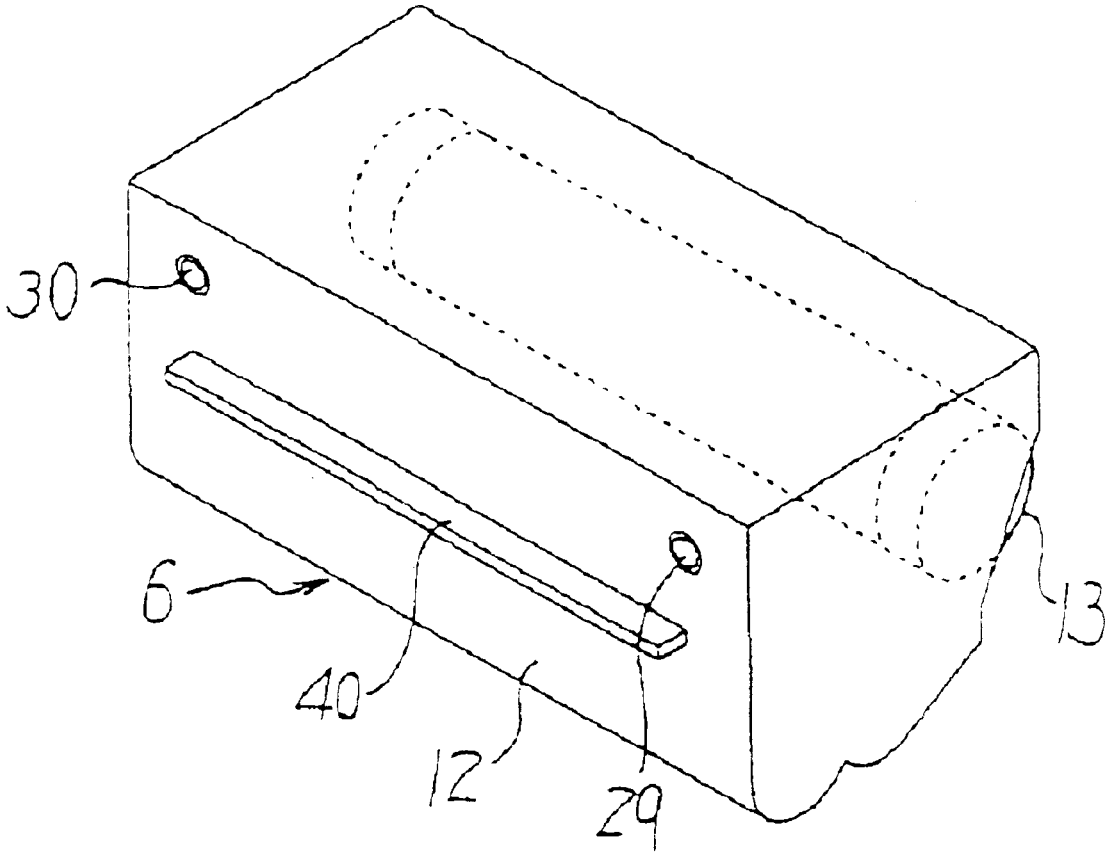
FIG. 13 is a perspective view showing the image forming unit included in the sixth embodiment.

FIGS. 12 and 13 show a sixth embodiment of the present invention identical with any one of the first to fifth embodiments except for the following. As shown, the exposing means for forming a latent image on the drum 13 is implemented as an LED (Light Emitting Diode) array 39 and arranged in the image forming unit 6. A radiation fin 40 is mounted on the rear end of the LED array 39 at one end and formed of metal having high thermal conductivity. The other end of the radiation fin 40 protrudes to the outside of the case 12.

The illustrative embodiment with the above configuration makes it needless to form the slit 21 for exposure in the case 12 and thereby enhances the hermetic sealing of the image forming unit 6. This prevents harmful substances from entering the image forming unit 6. While the LED array 39 produces much heat when turned on, the radiation fin 40 efficiently radiates the heat to the outside of the image forming unit 6 for thereby obviating, e.g., toner melting and insuring high image quality.

Figure 14:
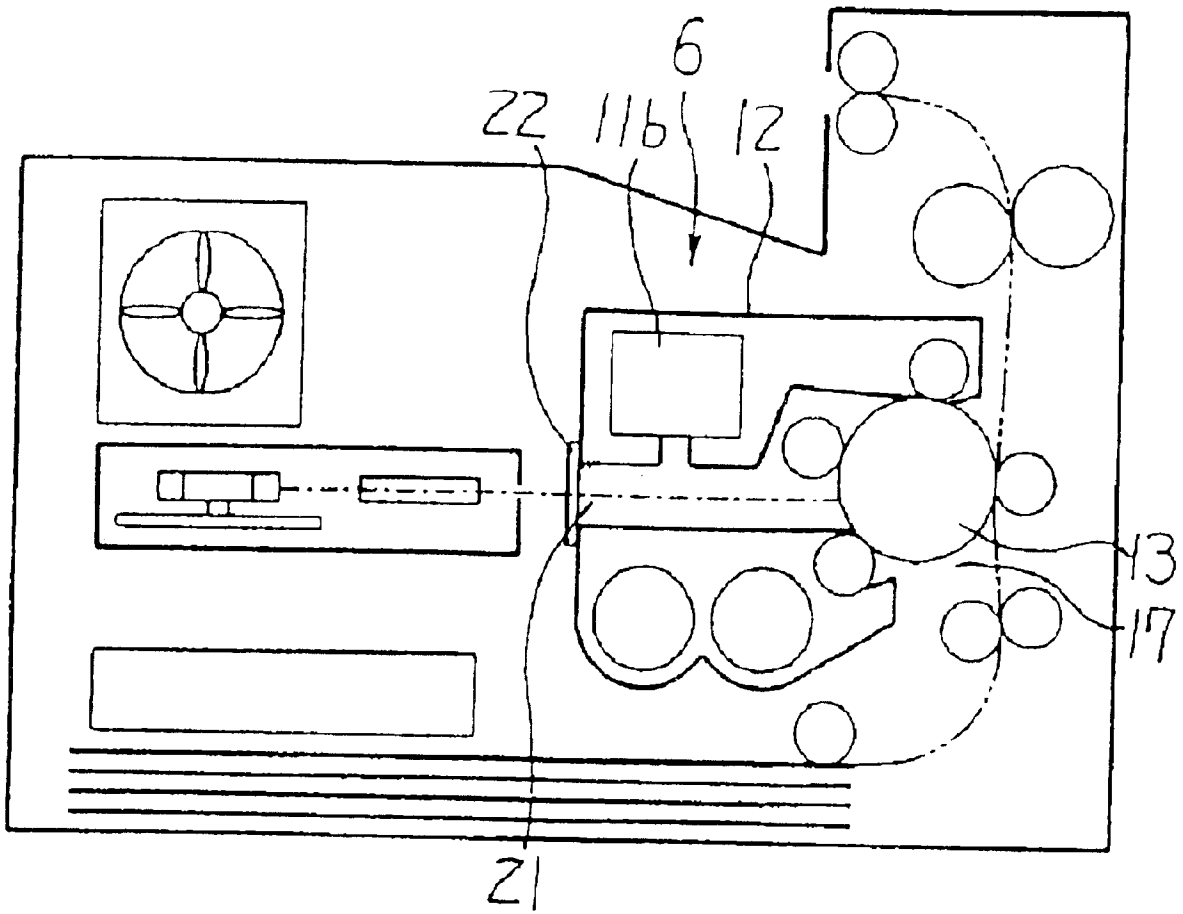
FIG. 14 is a vertical section showing a seventh embodiment of the present invention.
Figure 15:
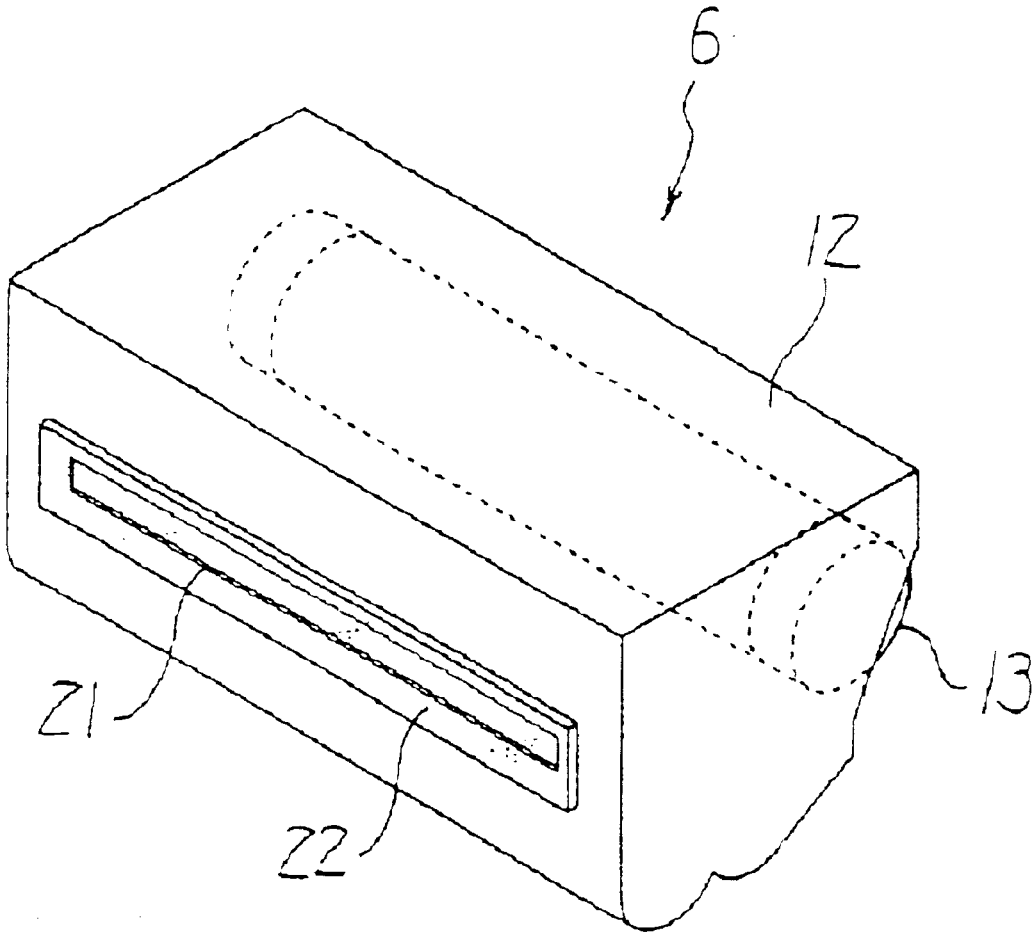
FIG. 15 is a perspective view showing the image forming unit included in the seventh embodiment.
Figure 16:
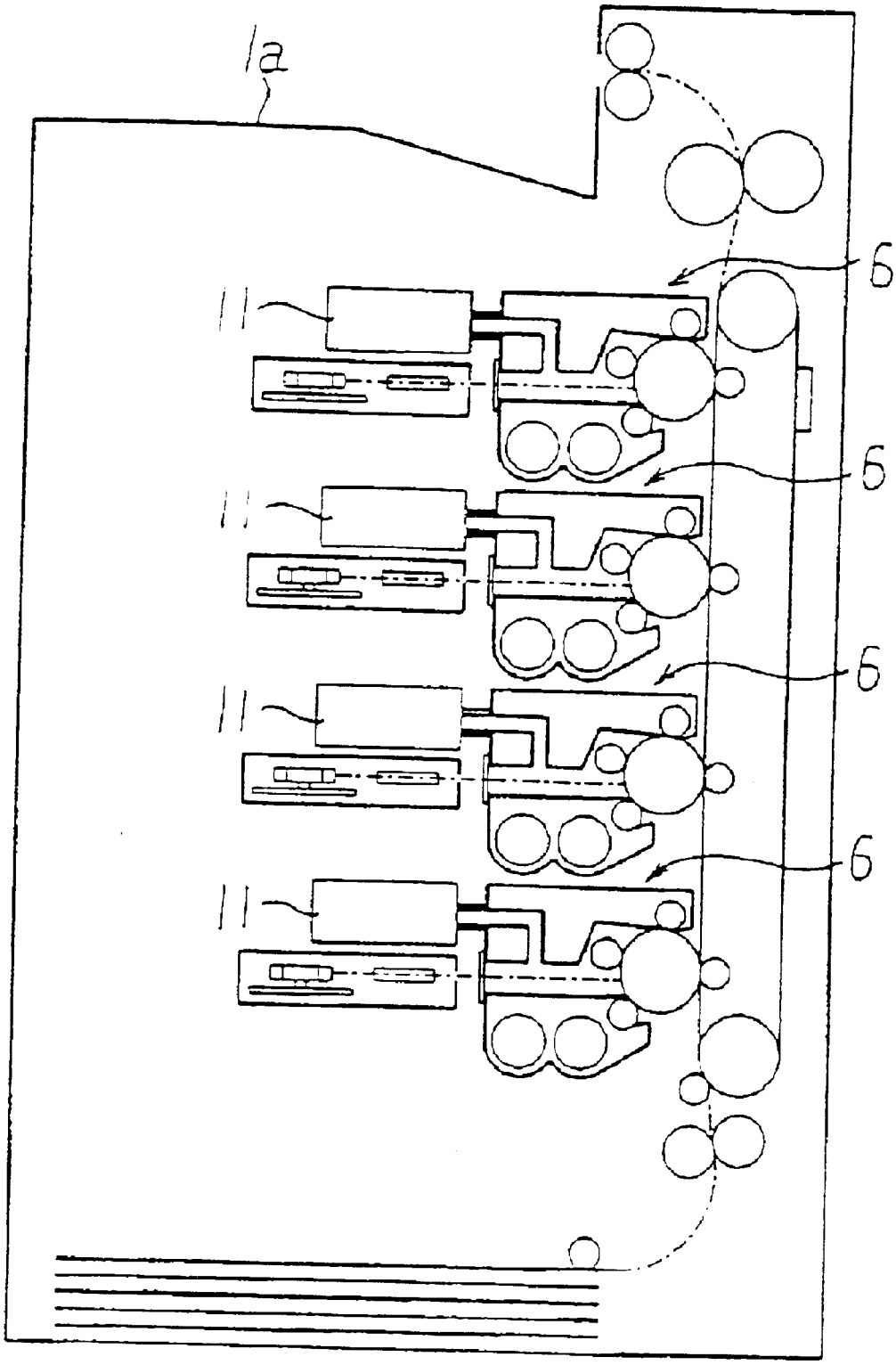
FIG. 16 is a vertical section showing an eighth embodiment of the present invention.

FIGS. 14 and 15 show a seventh embodiment of the present invention identical with any one of the first to sixth embodiments except for the following. As shown, the air conditioning means 11*b* is disposed in the image forming unit 6. To reduce the size of the air conditioning means 11*b*, the case 23 accommodates zeolite or similar ion-adsorbing material not shown. With this configuration, the air conditioning means 11*b* removes ammonia gas from air entering the image forming unit 6 for thereby solving various problems stated earlier. Further, The path and connecting members for connecting the image forming unit 6 and air conditioning means 11*b* are not necessary. The illustrative embodiment therefore reduces the size and cost of the entire apparatus including the image forming unit 6 and air conditioning means 11*b*.

FIG. 8 shows an eighth embodiment of the present invention. As shown, the image forming apparatus is implemented as an electrophotographic, color image, forming apparatus. The color image forming apparatus includes a casing 1*a* in which four image forming units 6 implemented by any one of the first to sixth embodiments each are arranged. The four image forming units 6 each are configured to form a toner image of a particular color. More specifically, the image forming units 6 are arranged in an array in a direction of sheet conveyance. Particular air conditioning means 11 is connected to each image forming unit 6.

The casing 1*a* accommodating four image forming units 6 is far larger in capacity than the casing 1 accommodating a single image forming unit 6. Therefore, substances harmful to image formation cannot be removed over the entire space of the casing 1*a* unless large-capacity air conditioning means is used. The illustrative embodiment does not remove harmful substances over the entire space of the casing 1*a*, but removes them only in the individual image forming means 6, thereby reducing the size and cost of the individual air conditioning means 11 as well as noise and power consumption.

While in the illustrative embodiment particular air conditioning means is connected to each image forming unit 6, a single air conditioning means may be connected to all of the image forming units 6, if desired. In the illustrative embodiment, the image forming units 6 sequentially transfers toner images of different colors to a single sheet one above the other. The present invention is, of course, similarly applicable to a color image forming apparatus of the type including an intermediate image transfer belt.

In summary, it will be seen that the present invention provides an electrophotographic image forming apparatus having various unprecedented advantages, as enumerated below.

(1) Air conditioning means removes substances harmful to image formation from air flowing into an image forming unit. In addition, an opening for image transfer is the only opening formed in the image forming unit and that might allow harmful substances into the image forming unit, so that the entry of harmful substances in the image forming unit is reduced. It follows that a photoconductive element is protected from deterioration ascribable to harmful substances and has its durability enhanced, insuring high image quality. Further, the air conditioning means does not cover the entire casing of the apparatus, but covers only the inside of the image forming unit, and is therefore small in size and cost, produces a minimum of noise, and consumes a minimum of power.

(2) Exposing means for forming a latent image on the photoconductive element is disposed in the image forming unit, so that a slit for a scanning beam does not have to be formed in the case of the image forming unit. This improves the hermetic sealing of the image forming unit and more surely intercepts harmful substances otherwise entering the image forming unit.

(3) When the above slit is formed in the case of the image forming unit, a transparent member covers the slit and insures the hermetic sealing of the image forming unit for thereby intercepting harmful substances otherwise entering the image forming unit.

(4) When the slit is formed in the case of the image forming unit and when the image forming unit is mounted to the casing of the apparatus, closing means closes the slit with a transparent member. This is also successful to achieve the above advantage (3).

(5) The air conditioning means is positioned at the inlet side of a path extending from the outside of the image forming unit to the same via the inside of the image forming unit. Therefore, air free from harmful substances can flow into the image forming unit.

(6) A circulation path is formed such that air inside the image forming unit is driven out of the image forming unit and again allowed into the image forming unit. The air conditioning means is positioned on the circulation path. Therefore, air containing harmful substances is prevented from entering the circulation path. This, coupled with the fact that the air conditioning means repeatedly conditions the same stream of air, noticeably reduces the amount of harmful substances in the image forming unit and thereby further enhances the durability of the photoconductive element and image quality.

(7) Contact type developing means faces the photoconductive element at the upstream side of the opening of the case in the direction of rotation of the photoconductive element. Such developing means plays the role of a seal member sealing the upstream side of the above opening, thereby preventing harmful substances from entering the image forming unit via the opening.

(8) Non-contact type developing means faces the photoconductive element at the upstream side of the opening of the case while the outlet of the path coincides with a gap for development formed by the developing means. In this configuration, air free from harmful substances and flown out of the image forming unit is exhausted via the above gap. It is therefore not necessary to form an exclusive exhaust port in the case of the image forming unit.

(9) Cleaning means contacts the photoconductive element at the downstream side of the opening in the direction of rotation of the photoconductive element. The cleaning means plays the role of a seal member sealing the downstream side of the opening and thereby prevents harmful substances from entering the image forming unit.

(10) Seal members are positioned at opposite ends of the opening in the direction of length in order to seal clearances between the edges of the opening and the photoconductive element. The seal members are also successful to prevent harmful substances from entering the image forming unit via the opening.

(11) The air conditioning means is positioned outside of the image forming unit. When the image forming unit is mounted to the casing of the apparatus, the air conditioning means and the case of the image forming unit are interconnected. Therefore, even when the air conditioning means produces heat, the heat is prevented from being transferred to the image forming unit; otherwise the heat would bring about toner melting and other troubles and would thereby lower image quality.

(12) When the air conditioning means is disposed in the image forming unit, a path and connecting members for connecting the air conditioning means and image forming unit are not necessary. This reduces the size and cost of the entire apparatus including the image forming unit and air adjusting means.

(13) The air conditioning means decomposes nitric compounds entered the image forming unit with an optical catalyst accommodated therein. The air conditioning means therefore prevents nitric compounds from being coupled with moisture in the air and producing nitric acid, nitrate and other ionized substances; otherwise, such ionized substances would deposit on the photoconductive element and would thereby bring about various troubles stated earlier.

(14) The air conditioning means removes moisture entered the image forming unit with dehumidifying means to thereby remove moisture around the photoconductive element; much moisture around the photoconductive element would bring about various problems also stated earlier.

(15) The air conditioning means removes ammonia gas around the photoconductive element by adsorbing ammonia ions entered the image forming unit with an ion adsorbing substance. Ammonia gas around the photoconductive element would also bring about various problems also stated previously.

Various modifications will become possible for those skilled in the art after receiving the teachings of the present disclosure without departing from the scope thereof.

What is claimed is:

1. An image forming apparatus comprising:

a casing;

an image forming unit comprising a case and a photoconductive element disposed in an opening of the case;

air conditioning means for removing harmful substances flowing into said image forming unit from outside of the case; and a seal member disposed around the opening of the case, the seal member configured to prevent a flow of air between an interior of the case and the outside of the case.

2. The apparatus as claimed in claim 1, further comprising exposing means disposed in said image forming unit for forming a latent image on said photoconductive element.

3. The apparatus as claimed in claim 2, further comprising a path configured such that air outside said image forming unit flows into said image forming unit and then flows out to the outside, wherein said air conditioning means is positioned at an inlet side of said path.

4. The apparatus as claimed in claim 3, further comprising non-contact type developing means facing, and out of contact with said photoconductive element at an upstream side of said opening in a direction of rotation of said photoconductive element, wherein an outlet side of said path coincides with a development gap formed by said non-contact type developing means.

5. The apparatus as claimed in claim 2, further comprising a circulation path configured such that air inside said image forming unit is discharged from said image forming unit and again introduced into said image forming unit, wherein said air conditioning means is positioned on said circulation path.

6. The apparatus as claimed in claim 2, further comprising contact type developing means contacting said photoconductive element at an upstream side of said opening in a direction of rotation of said photoconductive element.

7. The apparatus as claimed in claim 2, further comprising contact type cleaning means contacting said photoconductive element at a downstream side of said opening in a direction of rotation of said photoconductive element.

8. An image forming apparatus comprising:

a casing;

an image forming unit comprising a case accommodating at least a photoconductive element therein and formed with an opening for image transfer via which said photoconductive element is partly exposed to an outside, wherein said opening is an only opening allowing substances harmful to image formation into said case when said image forming unit is mounted to said casing;

air conditioning means for removing the harmful substances flowing into said image forming unit from the outside;

exposing means disposed in said image forming unit for forming a latent image on said photoconductive element; and a pair of seal members positioned at opposite ends of said opening in a direction of length adapted to seal clearances between said opening and said photoconductive element.

9. The apparatus as claimed in claim 2, wherein said air conditioning means is positioned outside of said image forming unit and is connected to said case of said image forming unit when said image forming unit is mounted to said casing.

10. The apparatus as claimed in claim 2, wherein said air conditioning means is disposed in said image forming unit.

11. The apparatus as claimed in claim 2, wherein said air conditioning means accommodates an optical catalyst thereinside.

12. The apparatus as claimed in claim 2, wherein said air conditioning means accommodates dehumidifying means thereinside.

13. The apparatus as claimed in claim 2, wherein said air conditioning means accommodates an ion adsorbing material thereinside.

14. The apparatus as claimed in claim 1, further comprising a slit formed in said case of said image forming unit configured to pass a light beam to form the latent image on said photoconductive element, and a transparent member covering said slit.

15. The apparatus as claimed in claim 14, further comprising a path configured such that air outside of said image forming unit is allowed into said image forming unit and then discharged to the outside, wherein said air conditioning means is positioned at an inlet side of said path.

16. An image forming apparatus comprising:

a casing;

an image forming unit comprising a case accommodating at least a photoconductive element therein and formed with an opening for image transfer via which said photoconductive element is partly exposed to an outside, wherein said opening is an only opening allowing substances harmful to image formation into said case when said image forming unit is mounted to said casing;

air conditioning means for removing the harmful substances flowing into said image forming unit from the outside;

a slit formed in said case of said image forming unit configured to pass a light beam to form the latent image on said photoconductive element;

a transparent member covering said slit;

a path configured such that air outside of said image forming unit is allowed into said image forming unit and then discharged to the outside, wherein said air conditioning means is positioned at an inlet side of said path; and non-contact type developing means facing and out of contact with said photoconductive element at an upstream side of said opening in a direction of rotation of said photoconductive element, wherein an outlet side of said path coincides with a development gap formed by said non-contact type developing means.

17. The apparatus as claimed in claim 14, further comprising exposing means disposed in said image forming unit for forming a latent image on said photoconductive element.

18. The apparatus as claimed in claim 17, further comprising a path configured such that air outside said image forming unit flows into said image forming unit and then flows out to the outside, wherein said air conditioning means is positioned at an inlet side of said path.

19. An image forming apparatus comprising:

a casing;

an image forming unit comprising a case accommodating at least a photoconductive element therein and formed with an opening for image transfer via which said photoconductive element is partly exposed to an outside, wherein said opening is an only opening allowing substances harmful to image formation into said case when said image forming unit is mounted to said casing;

air conditioning means for removing the harmful substances flowing into said image forming unit from the outside;

a slit formed in said case of said image forming unit configured to pass a light beam to form the latent image on said photoconductive element;

a transparent member covering said slit;

exposing means disposed in said image forming unit for forming a latent image on said photoconductive element;

a path configured such that air outside said image forming unit flows into said image forming unit and then flows out to the outside, wherein said air conditioning means is positioned at an inlet side of said path; and non-contact type developing means facing, and out of contact with said photoconductive element at an upstream side of said opening in a direction of rotation of said photoconductive element, wherein an outlet side of said path coincides with a development gap formed by said non-contact type developing means.

20. The apparatus as claimed in claim 14, further comprising a circulation path configured such that air inside said image forming unit is discharged from said image forming unit and again introduced into said image forming unit, wherein said air conditioning means is positioned on said circulation path.

21. The apparatus as claimed in claim 14, further comprising contact type developing means contacting said photoconductive element at an upstream side of said opening in a direction of rotation of said photoconductive element.

22. The apparatus as claimed in claim 14, further comprising contact type cleaning means contacting said photoconductive element at a downstream side of said opening in a direction of rotation of said photoconductive element.

23. An image forming apparatus comprising:

a casing;

an image forming unit comprising a case accommodating at least a photoconductive element therein and formed with an opening for image transfer via which said photoconductive element is partly exposed to an outside, wherein said opening is an only opening allowing substances harmful to image formation into said case when said image forming unit is mounted to said casing;

air conditioning means for removing the harmful substances flowing into said image forming unit from the outside;

a slit formed in said case of said image forming unit configured to pass a light beam to form the latent image on said photoconductive element;

a transparent member covering said slit; and a pair of seal members positioned at opposite ends of said opening in a direction of length adapted to seal clearances between said opening and said photoconductive element.

24. The apparatus as claimed in claim 14, wherein said air conditioning means is positioned outside of said image forming unit and is connected to said case of said image forming unit when said image forming unit is mounted to said casing.

25. An image forming comprising:

a casing;

an image forming unit comprising a case accommodating at least a photoconductive element therein and formed with an opening for image transfer via which said photoconductive element is partly exposed to an outside, wherein said opening is an only opening allowing substances harmful to image formation into said case when said image forming unit is mounted to said casing;

air conditioning means for removing the harmful substances flowing into said image forming unit from the outside;

a slit formed in said case of said image forming unit configured to pass a light beam to form the latent image on said photoconductive element; and a transparent member covering said slit, wherein said air conditioning means is disposed in said image forming unit.

26. An image forming comprising:

a casing;

an image forming unit comprising a case accommodating at least a photoconductive element therein and formed with an opening for image transfer via which said photoconductive element is partly exposed to an outside, wherein said opening is an only opening allowing substances harmful to image formation into said case when said image forming unit is mounted to said casing;

air conditioning means for removing the harmful substances flowing into said image forming unit from the outside;

a slit formed in said case of said image forming unit configured to pass a light beam to form the latent image on said photoconductive element; and a transparent member covering said slit, wherein said air conditioning means accommodates an optical catalyst thereinside.

27. An image forming comprising:

a casing;

an image forming unit comprising a case accommodating at least a photoconductive element therein and formed with an opening for image transfer via which said photoconductive element is partly exposed to an outside, wherein said opening is an only opening allowing substances harmful to image formation into said case when said image forming unit is mounted to said casing;

air conditioning means for removing the harmful substances flowing into said image forming unit from the outside;

a slit formed in said case of said image forming unit configured to pass a light beam to form the latent image on said photoconductive element; and a transparent member covering said slit, wherein said air conditioning means accommodates dehumidifying means thereinside.

28. An image forming comprising:

a casing;

an image forming unit comprising a case accommodating at least a photoconductive element therein and formed with an opening for image transfer via which said photoconductive element is partly exposed to an outside, wherein said opening is an only opening allowing substances harmful to image formation into said case when said image forming unit is mounted to said casing;

air conditioning means for removing the harmful substances flowing into said image forming unit from the outside;

a slit formed in said case of said image forming unit configured to pass a light beam to form the latent image on said photoconductive element; and a transparent member covering said slit, wherein said air conditioning means accommodates an ion adsorbing material thereinside.

29. The apparatus as claimed in claim 1, further comprising a slit formed in said case of said image forming unit configured to pass a light beam to form a latent image on said photoconductive element, and closing means for closing said slit with a transparent member when said image forming unit is mounted to said casing.

30. The apparatus as claimed in claim 29, further comprising a path configured such that air outside of said image forming unit is allowed into said image forming unit and then discharged to the outside, wherein said air conditioning means is positioned at an inlet side of said path.

31. An image forming apparatus comprising:

a casing;

an image forming unit comprising a case accommodating at least a photoconductive element therein and formed with an opening for image transfer via which said photoconductive element is partly exposed to an outside, wherein said opening is an only opening allowing substances harmful to image formation into said case when said image forming unit is mounted to said casing;

air conditioning means for removing the harmful substances flowing into said image forming unit from the outside;

a slit formed in said case of said image forming unit configured to pass a light beam to form a latent image on said photoconductive element;

closing means for closing said slit with a transparent member when said image forming unit is mounted to said casing;

a path configured such that air outside of said image forming unit is allowed into said image forming unit and then discharged to the outside, wherein said air conditioning means is positioned at an inlet side of said path; and non-contact type developing means facing and out of contact with said photoconductive element at an upstream side of said opening in a direction of rotation of said photoconductive element, wherein an outlet side of said path coincides with a development gap formed by said non-contact type developing means.

32. The apparatus as claimed in claim 29, further comprising exposing means disposed in said image forming unit for forming a latent image on said photoconductive element.

33. The apparatus as claimed in claim 32, further comprising a path configured such that air outside said image forming unit flows into said image forming unit and then flows out to the outside, wherein said air conditioning means is positioned at an inlet side of said path.

34. An image forming apparatus comprising:

a casing;

an image forming unit comprising a case accommodating at least a photoconductive element therein and formed with an opening for image transfer via which said photoconductive element is partly exposed to an outside, wherein said opening is an only opening allowing substances harmful to image formation into said case when said image forming unit is mounted to said casing;

air conditioning means for removing the harmful substances flowing into said image forming unit from the outside;

a slit formed in said case of said image forming unit configured to pass a light beam to form a latent image on said photoconductive element;

closing means for closing said slit with a transparent member when said image forming unit is mounted to said casing;

exposing means disposed in said image forming unit for forming a latent image on said photoconductive element;

a path configured such that air outside said image forming unit flows into said image forming unit and then flows out to the outside, wherein said air conditioning means is positioned at an inlet side of said path; and non-contact type developing means facing and out of contact with said photoconductive element at an upstream side of said opening in a direction of rotation of said photoconductive element, wherein an outlet side of said path coincides with a development gap formed by said non-contact type developing means.

35. The apparatus as claimed in claim 29, further comprising a circulation path configured such that air inside said image forming unit is discharged from said image forming unit and again introduced into said image forming unit, wherein said air conditioning means is positioned on said circulation path.

36. The apparatus as claimed in claim 29, further comprising contact type developing means contacting said photoconductive element at an upstream side of said opening in a direction of rotation of said photoconductive element.

37. The apparatus as claimed in claim 29, further comprising contact type cleaning means contacting said photoconductive element at a downstream side of said opening in a direction of rotation of said photoconductive element.

38. An image forming apparatus comprising:

a casing;

an image forming unit comprising a case accommodating at least a photoconductive element therein and formed with an opening for image transfer via which said photoconductive element is partly exposed to an outside, wherein said opening is an only opening allowing substances harmful to image formation into said case when said image forming unit is mounted to said casing;

air conditioning means for removing the harmful substances flowing into said image forming unit from the outside;

a slit formed in said case of said image forming unit configured to pass a light beam to form a latent image on said photoconductive element;

closing means for closing said slit with a transparent member when said image forming unit is mounted to said casing; and a pair of seal members positioned at opposite ends of said opening in a direction of length configured to seal clearances between said opening and said photoconductive element.

39. The apparatus as claimed in claim 29, wherein said air conditioning means is positioned outside of said image forming unit and is connected to said case of said image forming unit when said image forming unit is mounted to said casing.

40. An image forming apparatus comprising:

a casing;

an image forming unit comprising a case accommodating at least a photoconductive element therein and formed with an opening for image transfer via which said photoconductive element is partly exposed to an outside, wherein said opening is an only opening allowing substances harmful to image formation into said case when said image forming unit is mounted to said casing;

air conditioning means for removing the harmful substances flowing into said image forming unit from the outside;

a slit formed in said case of said image forming unit configured to pass a light beam to form a latent image on said photoconductive element; and closing means for closing said slit with a transparent member when said image forming unit is mounted to said casing, wherein said air conditioning means is disposed in said image forming unit.

41. An image forming apparatus comprising:

a casing;

an image forming unit comprising a case accommodating at least a photoconductive element therein and formed with an opening for image transfer via which said photoconductive element is partly exposed to an outside, wherein said opening is an only opening allowing substances harmful to image formation into said case when said image forming unit is mounted to said casing;

air conditioning means for removing the harmful substances flowing into said image forming unit from the outside;

a slit formed in said case of said image forming unit configured to pass a light beam to form a latent image on said photoconductive element; and closing means for closing said slit with a transparent member when said image forming unit is mounted to said casing, wherein said air conditioning means accommodates an optical catalyst thereinside.

42. An image forming apparatus comprising:

a casing;

an image forming unit comprising a case accommodating at least a photoconductive element therein and formed with an opening for image transfer via which said photoconductive element is partly exposed to an outside, wherein said opening is an only opening allowing substances harmful to image formation into said case when said image forming unit is mounted to said casing;

air conditioning means for removing the harmful substances flowing into said image forming unit from the outside;

a slit formed in said case of said image forming unit configured to pass a light beam to form a latent image on said photoconductive element; and closing means for closing said slit with a transparent member when said image forming unit is mounted to said casing, wherein said air conditioning means accommodates dehumidifying means thereinside.

43. An image forming apparatus comprising:

a casing;

an image forming unit comprising a case accommodating at least a photoconductive element therein and formed with an opening for image transfer via which said photoconductive element is partly exposed to an outside, wherein said opening is an only opening allowing substances harmful to image formation into said case when said image forming unit is mounted to said casing;

air conditioning means for removing the harmful substances flowing into said image forming unit from the outside;

a slit formed in said case of said image forming unit configured to pass a light beam to form a latent image on said photoconductive element; and closing means for closing said slit with a transparent member when said image forming unit is mounted to said casing, wherein said air conditioning means accommodates an ion adsorbing material thereinside.

44. The apparatus as claimed in claim 1, further comprising a path configured such that air outside said image forming unit flows into said image forming unit and then flows out to the outside, wherein said air conditioning means is positioned at an inlet side of said path.

45. The apparatus as claimed in claim 44, further comprising contact type developing means contacting said photoconductive element at an upstream side of said opening in a direction of rotation of said photoconductive element.

46. The apparatus as claimed in claim 44, further comprising non-contact type developing means facing and out of contact with said photoconductive element at an upstream side of said opening in a direction of rotation of said photoconductive element, wherein an outlet side of said path coincides with a development gap formed by said non-contact type developing means.

47. The apparatus as claimed in claim 44, further comprising contact type cleaning means contacting said photoconductive element at a downstream side of said opening in a direction of rotation of said photoconductive element.

48. An image forming apparatus comprising:

a casing;

an image forming unit comprising a case accommodating at least a photoconductive element therein and formed with an opening for image transfer via which said photoconductive element is partly exposed to an outside, wherein said opening is an only opening allowing substances harmful to image formation into said case when said image forming unit is mounted to said casing;

air conditioning means for removing the harmful substances flowing into said image forming unit from the outside;

a path configured such that air outside said image forming unit flows into said image forming unit and then flows out to the outside, wherein said air conditioning means is positioned at an inlet side of said path; and a pair of seal members positioned at opposite ends of said opening in a direction of length configured to seal clearances between said opening and said photoconductive element.

49. The apparatus as claimed in claim 44, wherein said air conditioning means is positioned outside of said image forming unit and is connected to said case of said image forming unit when said image forming unit is mounted to said casing.

50. The apparatus as claimed in claim 44, wherein said air conditioning means is disposed in said image forming unit.

51. The apparatus as claimed in claim 44, wherein said air conditioning means accommodates an optical catalyst thereinside.

52. The apparatus as claimed in claim 44, wherein said air conditioning means accommodates dehumidifying means thereinside.

53. The apparatus as claimed in claim 44, wherein said air conditioning means accommodates an ion adsorbing material thereinside.

54. The apparatus as claimed in claim 1, further comprising a circulation path configured such that air inside said image forming unit is discharged from said image forming unit and again introduced into said image forming unit, wherein said air conditioning means is positioned on said circulation path.

55. The apparatus as claimed in claim 54, further comprising contact type developing means contacting said photoconductive element at an upstream side of said opening in a direction of rotation of said photoconductive element.

56. The apparatus as claimed in claim 54, further comprising contact type cleaning means contacting said photoconductive element at a downstream side of said opening in a direction of rotation of said photoconductive element.

57. An image forming apparatus comprising:

a casing;

an image forming unit comprising a case accommodating at least a photoconductive element therein and formed with an opening for image transfer via which said photoconductive element is partly exposed to an outside, wherein said opening is an only opening allowing substances harmful to image formation into said case when said image forming unit is mounted to said casing;

air conditioning means for removing the harmful substances flowing into said image forming unit from the outside;

a circulation path configured such that air inside said image forming unit is discharged from said image forming unit and again introduced into said image forming unit, wherein said air conditioning means is positioned on said circulation path and a pair of seal members positioned at opposite ends of said opening in a direction of length configured to seal clearances between said opening and said photoconductive element.

58. The apparatus as claimed in claim 54, wherein said air conditioning means is positioned outside of said image forming unit and is connected to said case of said image forming unit when said image forming unit is mounted to said casing.

59. The apparatus as claimed in claim 54, wherein said air conditioning means is disposed in said image forming unit.

60. The apparatus as claimed in claim 54, wherein said air conditioning means accommodates an optical catalyst thereinside.

61. The apparatus as claimed in claim 54, wherein said air conditioning means accommodates dehumidifying means thereinside.

62. The apparatus as claimed in claim 54, wherein said air conditioning means accommodates an ion adsorbing material thereinside.

63. The apparatus as claimed in claim 1, further comprising contact type developing means contacting said photoconductive element at an upstream side of said opening in a direction of rotation of said photoconductive element.

64. The apparatus as claimed in claim 63, further comprising contact type cleaning means contacting said photoconductive element at a downstream side of said opening in a direction of rotation of said photoconductive element.

65. An image forming apparatus comprising:

a casing;

an image forming unit comprising a case accommodating at least a photoconductive element therein and formed with an opening for image transfer via which said photoconductive element is partly exposed to an outside, wherein said opening is an only opening allowing substances harmful to image formation into said case when said image forming unit is mounted to said casing;

air conditioning means for removing the harmful substances flowing into said image forming unit from the outside;

contact type developing means contacting said photoconductive element at an upstream side of said opening in a direction of rotation of said photoconductive element; and a pair of seal members positioned at opposite ends of said opening in a direction of length configured to seal clearances between said opening and said photoconductive element.

66. The apparatus as claimed in claim 63, wherein said air conditioning means is positioned outside of said image forming unit and is connected to said case of said image forming unit when said image forming unit is mounted to said casing.

67. An image forming apparatus comprising:

a casing;

an image forming unit comprising a case accommodating at least a photoconductive element therein and formed with an opening for image transfer via which said photoconductive element is partly exposed to an outside, wherein said opening is an only opening allowing substances harmful to image formation into said case when said image forming unit is mounted to said casing;

air conditioning means for removing the harmful substances flowing into said image forming unit from the outside; and contact type developing means contacting said photoconductive element at an upstream side of said opening in a direction of rotation of said photoconductive element, wherein said air conditioning means is disposed in said image forming unit.

68. An image forming apparatus comprising:

a casing;

an image forming unit comprising a case accommodating at least a photoconductive element therein and formed with an opening for image transfer via which said photoconductive element is partly exposed to an outside, wherein said opening is an only opening allowing substances harmful to image formation into said case when said image forming unit is mounted to said casing;

air conditioning means for removing the harmful substances flowing into said image forming unit from the outside; and contact type developing means contacting said photoconductive element at an upstream side of said opening in a direction of rotation of said photoconductive element, wherein said air conditioning means accommodates an optical catalyst thereinside.

69. An image forming apparatus comprising:

a casing;

an image forming unit comprising a case accommodating at least a photoconductive element therein and formed with an opening for image transfer via which said photoconductive element is partly exposed to an outside, wherein said opening is an only opening allowing substances harmful to image formation into said case when said image forming unit is mounted to said casing;

air conditioning means for removing the harmful substances flowing into said image forming unit from the outside; and contact type developing means contacting said photoconductive element at an upstream side of said opening in a direction of rotation of said photoconductive element, wherein said air conditioning means accommodates dehumidifying means thereinside.

70. An image forming apparatus comprising:

a casing;

an image forming unit comprising a case accommodating at least a photoconductive element therein and formed with an opening for image transfer via which said photoconductive element is partly exposed to an outside, wherein said opening is an only opening allowing substances harmful to image formation into said case when said image forming unit is mounted to said casing;

air conditioning means for removing the harmful substances flowing into said image forming unit from the outside; and contact type developing means contacting said photoconductive element at an upstream side of said opening in a direction of rotation of said photoconductive element, wherein said air conditioning means accommodates an ion adsorbing material thereinside.

71. The apparatus as claimed in claim 1, further comprising contact type cleaning means contacting said photoconductive element at a downstream side of said opening in a direction of rotation of said photoconductive element.

72. An image forming apparatus comprising:

a casing;

an image forming unit comprising a case accommodating at least a photoconductive element therein and formed with an opening for image transfer via which said photoconductive element is partly exposed to an outside, wherein said opening is an only opening allowing substances harmful to image formation into said case when said image forming unit is mounted to said casing;

air conditioning means for removing the harmful substances flowing into said image forming unit from the outside;

contact type cleaning means contacting said photoconductive element at a downstream side of said opening in a direction of rotation of said photoconductive element; and a pair of seal members positioned at opposite ends of said opening in a direction of length configured to seal clearances between said opening and said photoconductive element.

73. The apparatus as claimed in claim 71, wherein said air conditioning means is positioned outside of said image forming unit and is connected to said case of said image forming unit when said image forming unit is mounted to said casing.

74. An image forming apparatus comprising:

a casing;

an image forming unit comprising a case accommodating at least a photoconductive element therein and formed with an opening for image transfer via which said photoconductive element is partly exposed to an outside, wherein said opening is an only opening allowing substances harmful to image formation into said case when said image forming unit is mounted to said casing;

air conditioning means for removing the harmful substances flowing into said image forming unit from the outside; and contact type cleaning means contacting said photoconductive element at a downstream side of said opening in a direction of rotation of said photoconductive element, wherein said air conditioning means is disposed in said image forming unit.

75. The apparatus as claimed in claim 71, wherein said air conditioning means accommodates an optical catalyst thereinside.

76. The apparatus as claimed in claim 71, wherein said air conditioning means accommodates dehumidifying means thereinside.

77. The apparatus as claimed in claim 71, wherein said air conditioning means accommodates an ion adsorbing material thereinside.

78. An image forming apparatus comprising:

a casing;

an image forming unit comprising a case accommodating at least a photoconductive element therein and formed with an opening for image transfer via which said photoconductive element is partly exposed to an outside, wherein said opening is an only opening allowing substances harmful to image formation into said case when said image forming unit is mounted to said casing;

air conditioning means for removing the harmful substances flowing into said image forming unit from the outside; and a pair of seal members positioned at opposite ends of said opening in a direction of length configured to seal clearances between said opening and said photoconductive element.

79. The apparatus as claimed in claim 78, wherein said air conditioning means is positioned outside of said image forming unit and is connected to said case of said image forming unit when said image forming unit is mounted to said casing.

80. The apparatus as claimed in claim 78, wherein said air conditioning means is disposed in said image forming unit.

81. The apparatus as claimed in claim 78, wherein said air conditioning means accommodates an optical catalyst thereinside.

82. The apparatus as claimed in claim 78, wherein said air conditioning means accommodates dehumidifying means thereinside.

83. The apparatus as claimed in claim 78, wherein said air conditioning means accommodates an ion adsorbing material thereinside.

84. The apparatus as claimed in claim 1, wherein said air conditioning means is positioned outside of said image forming unit and is connected to said case of said image forming unit when said image forming unit is mounted to said casing.

85. An image forming apparatus comprising:

a casing;

an image forming unit comprising a case accommodating at least a photoconductive element therein and formed with an opening for image transfer via which said photoconductive element is partly exposed to an outside, wherein said opening is an only opening allowing substances harmful to image formation into said case when said image forming unit is mounted to said casing; and air conditioning means for removing the harmful substances flowing into said image forming unit from the outside, wherein said air conditioning means is disposed in said image forming unit.

86. The apparatus as claimed in claim 84, wherein said air conditioning means accommodates an optical catalyst thereinside.

87. The apparatus as claimed in claim 84, wherein said air conditioning means accommodates dehumidifying means thereinside.

88. The apparatus as claimed in claim 84, wherein said air conditioning means accommodates an ion adsorbing material thereinside.

89. An image forming apparatus comprising:

a casing;

an image forming unit comprising a case accommodating at least a photoconductive element therein and formed with an opening for image transfer via which said photoconductive element is partly exposed to an outside, wherein said opening is an only opening allowing substances harmful to image formation into said case when said image forming unit is mounted to said casing; and air conditioning means for removing the harmful substances flowing into said image forming unit from the outside, wherein said air conditioning means is disposed in said image forming unit.

90. The apparatus as claimed in claim 89, wherein said air conditioning means accommodates an optical catalyst thereinside.

91. The apparatus as claimed in claim 89, wherein said air conditioning means accommodates dehumidifying means thereinside.

92. The apparatus as claimed in claim 89, wherein said air conditioning means accommodates an ion adsorbing material thereinside.

93. The apparatus as claimed in claim 1, wherein said air conditioning means accommodates an optical catalyst thereinside.

94. The apparatus as claimed in claim 93, wherein said air conditioning means accommodates dehumidifying means thereinside.

95. The apparatus as claimed in claim 1, wherein said air conditioning means accommodates an ion adsorbing material thereinside.

96. The apparatus as claimed in claim 1, wherein said air conditioning means accommodates dehumidifying means thereinside.

97. An image forming apparatus comprising:

a casing;

an image forming unit comprising a case and a photoconductive element disposed in an opening of the case;

an air conditioning device configured to remove harmful substances flowing into the image forming unit from outside of the case; and a seal member disposed around the opening of the case, the seal member configured to prevent a flow of air between an interior of the case and the outside of the case.

98. An image forming apparatus comprising:

a casing;

an image forming unit comprising a case accommodating at least a photoconductive element therein and formed with an opening for image transfer via which the photoconductive element is partly exposed to an outside, wherein the opening is an only opening allowing substances harmful to image formation into the case when the image forming unit is mounted to the casing;

an air conditioning device configured to remove the harmful substances flowing into the image forming unit from the outside;

an exposing device disposed in the image forming unit configured to form a latent image on the photoconductive element; and a pair of seal members positioned at opposite ends of the opening in a direction of length adapted to seal clearances between the opening and the photoconductive element.

99. An image forming apparatus comprising:

a casing;

an image forming unit comprising a case accommodating at least a photoconductive element therein and formed with an opening for image transfer via which the photoconductive element is partly exposed to an outside, wherein the opening is an only opening allowing substances harmful to image formation into the case when the image forming unit is mounted to the casing;

an air conditioning device configured to remove the harmful substances flowing into the image forming unit from the outside;

a slit formed in the case of the image forming unit configured to pass a light beam to form the latent image on the photoconductive element;

a transparent member covering the slit;

a path configured such that air outside of the image forming unit is allowed into the image forming unit and then discharged to the outside, wherein the air conditioning device is positioned at an inlet side of the path; and a non-contact type developing device facing and out of contact with the photoconductive element at an upstream side of the opening in a direction of rotation of the photoconductive element, wherein an outlet side of the path coincides with a development gap formed by the non-contact type developing device.

100. An image forming apparatus comprising:

a casing;

an image forming unit comprising a case accommodating at least a photoconductive element therein and formed with an opening for image transfer via which the photoconductive element is partly exposed to an outside, wherein the opening is an only opening allowing substances harmful to image formation into the case when the image forming unit is mounted to the casing;

an air conditioning device configured to remove the harmful substances flowing into the image forming unit from the outside;

a slit formed in the case of the image forming unit configured to pass a light beam to form the latent image on the photoconductive element;

a transparent member covering the slit;

an exposing device disposed in the image forming unit configured to form a latent image on the photoconductive element;

a path configured such that air outside the image forming unit flows into the image forming unit and then flows out to the outside, wherein the air conditioning device is positioned at an inlet side of the path; and a non-contact type developing device facing and out of contact with the photoconductive element at an upstream side of the opening in a direction of rotation of the photoconductive element, wherein an outlet side of the path coincides with a development gap formed by the non-contact type developing device.

101. An image forming apparatus comprising:

a casing;

an image forming unit comprising a case accommodating at least a photoconductive element therein and formed with an opening for image transfer via which the photoconductive element is partly exposed to an outside, wherein the opening is an only opening allowing substances harmful to image formation into the case when the image forming unit is mounted to the casing;

an air conditioning device configured to remove the harmful substances flowing into the image forming unit from the outside;

a slit formed in the case of the image forming unit configured to pass a light beam to form the latent image on the photoconductive element;

a transparent member covering the slit; and a pair of seal members positioned at opposite ends of the opening in a direction of length adapted to seal clearances between the opening and the photoconductive element.

102. An image forming comprising:

a casing;

an image forming unit comprising a case accommodating at least a photoconductive element therein and formed with an opening for image transfer via which the photoconductive element is partly exposed to an outside, wherein the opening is an only opening allowing substances harmful to image formation into the case when the image forming unit is mounted to the casing;

an air conditioning device configured to remove the harmful substances flowing into the image forming unit from the outside;

a slit formed in the case of the image forming unit configured to pass a light beam to form the latent image on the photoconductive element; and a transparent member covering the slit, wherein the air conditioning device is disposed in the image forming unit.

103. An image forming comprising:

a casing;

an image forming unit comprising a case accommodating at least a photoconductive element therein and formed with an opening for image transfer via which the photoconductive element is partly exposed to an outside, wherein the opening is an only opening allowing substances harmful to image formation into the case when the image forming unit is mounted to the casing;

an air conditioning device configured to remove the harmful substances flowing into the image forming unit from the outside;

a slit formed in the case of the image forming unit configured to pass a light beam to form the latent image on the photoconductive element; and a transparent member covering the slit, wherein the air conditioning device accommodates an optical catalyst thereinside.

104. An image forming comprising:

a casing;

an image forming unit comprising a case accommodating at least a photoconductive element therein and formed with an opening for image transfer via which the photoconductive element is partly exposed to an outside, wherein the opening is an only opening allowing substances harmful to image formation into the case when the image forming unit is mounted to the casing;

an air conditioning device configured to remove the harmful substances flowing into the image forming unit from the outside;

a slit formed in the case of the image forming unit configured to pass a light beam to form the latent image on the photoconductive element; and a transparent member covering the slit, wherein the air conditioning device accommodates a dehumidifying device thereinside.

105. An image forming comprising:

a casing;

an image forming unit comprising a case accommodating at least a photoconductive element therein and formed with an opening for image transfer via which the photoconductive element is partly exposed to an outside, wherein the opening is an only opening allowing substances harmful to image formation into the case when the image forming unit is mounted to the casing;

an air conditioning device configured to remove the harmful substances flowing into the image forming unit from the outside;

a slit formed in the case of the image forming unit configured to pass a light beam to form the latent image on the photoconductive element; and a transparent member covering the slit, wherein the air conditioning device accommodates an ion adsorbing material thereinside.

106. An image forming apparatus comprising:

a casing;

an image forming unit comprising a case accommodating at least a photoconductive element therein and formed with an opening for image transfer via which the photoconductive element is partly exposed to an outside, wherein the opening is an only opening allowing substances harmful to image formation into the case when the image forming unit is mounted to the casing;

an air conditioning device configured to remove the harmful substances flowing into the image forming unit from the outside;

a slit formed in the case of the image forming device configured to pass a light beam to form a latent image on the photoconductive element;

a closing device configured to close the slit with a transparent member when the image forming unit is mounted to the casing;

a path configured such that air outside of the image forming unit is allowed into the image forming unit and then discharged to the outside, wherein the air conditioning device is positioned at an inlet side of the path; and a non-contact type developing device facing and out of contact with the photoconductive element at an upstream side of the opening in a direction of rotation of the photoconductive element, wherein an outlet side of the path coincides with a development gap formed by the non-contact type developing device.

107. An image forming apparatus comprising:

a casing;

an image forming unit comprising a case accommodating at least a photoconductive element therein and formed with an opening for image transfer via which the photoconductive element is partly exposed to an outside, wherein the opening is an only opening allowing substances harmful to image formation into the case when the image forming unit is mounted to the casing;

an air conditioning device configured to remove the harmful substances flowing into the image forming unit from the outside;

a slit formed in the case of the image forming unit configured to pass a light beam to form a latent image on the photoconductive element;

a closing device configured to close the slit with a transparent member when the image forming unit is mounted to the casing;

an exposing device disposed in the image forming unit configured to form a latent image on the photoconductive element;

a path configured such that air outside the image forming unit flows into the image forming unit and then flows out to the outside, wherein the air conditioning device is positioned at an inlet side of the path; and a non-contact type developing device facing and out of contact with the photoconductive element at an upstream side of the opening in a direction of rotation of the photoconductive element, wherein an outlet side of the path coincides with a development gap formed by the non-contact type developing device.

108. An image forming apparatus comprising:

a casing;

an image forming unit comprising a case accommodating at least a photoconductive element therein and formed with an opening for image transfer via which the photoconductive element is partly exposed to an outside, wherein the opening is an only opening allowing substances harmful to image formation into the case when the image forming unit is mounted to the casing;

an air conditioning device configured to remove the harmful substances flowing into the image forming unit from the outside;

a slit formed in the case of the image forming device configured to pass a light beam to form a latent image on the photoconductive element;

a closing device configured to close the slit with a transparent member when the image forming unit is mounted to the casing; and a pair of seal members positioned at opposite ends of the opening in a direction of length configured to seal clearances between the opening and the photoconductive element.

109. An image forming apparatus comprising:

a casing;

an image forming unit comprising a case accommodating at least a photoconductive element therein and formed with an opening for image transfer via which the photoconductive element is partly exposed to an outside, wherein the opening is an only opening allowing substances harmful to image formation into the case when the image forming unit is mounted to the casing;

an air conditioning device configured to remove the harmful substances flowing into the image forming unit from the outside;

a slit formed in the case of the image forming device configured to pass a light beam to form a latent image on the photoconductive element; and a closing device configured to close the slit with a transparent member when the image forming unit is mounted to the casing, wherein the air conditioning device is disposed in the image forming unit.

110. An image forming apparatus comprising:

a casing;

an image forming unit comprising a case accommodating at least a photoconductive element therein and formed with an opening for image transfer via which the photoconductive element is partly exposed to an outside, wherein the opening is an only opening allowing substances harmful to image formation into the case when the image forming unit is mounted to the casing;

an air conditioning device configured to remove the harmful substances flowing into the image forming unit from the outside;

a slit formed in the case of the image forming device configured to pass a light beam to form a latent image on the photoconductive element; and a closing device configured to close the slit with a transparent member when the image forming unit is mounted to the casing, wherein the air conditioning device accommodates an optical catalyst thereinside.

111. An image forming apparatus comprising:

a casing;

an image forming unit comprising a case accommodating at least a photoconductive element therein and formed with an opening for image transfer via which the photoconductive element is partly exposed to an outside, wherein the opening is an only opening allowing substances harmful to image formation into the case when the image forming unit is mounted to the casing;

an air conditioning device configured to remove the harmful substances flowing into the image forming unit from the outside;

a slit formed in the case of the image forming device configured to pass a light beam to form a latent image on the photoconductive element; and a closing device configured to close the slit with a transparent member when the image forming unit is mounted to the casing, wherein the air conditioning device accommodates dehumidifying device thereinside.

112. An image forming apparatus comprising:

a casing;

an image forming unit comprising a case accommodating at least a photoconductive element therein and formed with an opening for image transfer via which the photoconductive element is partly exposed to an outside, wherein the opening is an only opening allowing substances harmful to image formation into the case when the image forming unit is mounted to the casing;

an air conditioning device configured to remove the harmful substances flowing into the image forming unit from the outside;

a slit formed in the case of the image forming device configured to pass a light beam to form a latent image on the photoconductive element; and a closing device configured to close the slit with a transparent member when the image forming unit is mounted to the casing, wherein the air conditioning device accommodates an ion adsorbing material thereinside.

113. An image forming apparatus comprising:

a casing;

an image forming unit comprising a case accommodating at least a photoconductive element therein and formed with an opening for image transfer via which the photoconductive element is partly exposed to an outside, wherein the opening is an only opening allowing substances harmful to image formation into the case when the image forming unit is mounted to the casing;

an air conditioning device configured to remove the harmful substances flowing into the image forming unit from the outside;

a path configured such that air outside the image forming unit flows into the image forming unit and then flows out to the outside, wherein the air conditioning device is positioned at an inlet side of the path; and a pair of seal members positioned at opposite ends of the opening in a direction of length configured to seal clearances between the opening and the photoconductive element.

114. An image forming apparatus comprising:

a casing;

an image forming unit comprising a case accommodating at least a photoconductive element therein and formed with an opening for image transfer via which the photoconductive element is partly exposed to an outside, wherein the opening is an only opening allowing substances harmful to image formation into the case when the image forming unit is mounted to the casing;

an air conditioning device configured to remove the harmful substances flowing into the image forming unit from the outside;

a circulation path configured such that air inside the image forming unit is discharged from the image forming unit and again introduced into the image forming unit, wherein the air conditioning device is positioned on the circulation path; and a pair of seal members positioned at opposite ends of the opening in a direction of length configured to seal clearances between the opening and the photoconductive element.

115. An image forming apparatus comprising:

a casing;

an image forming unit comprising a case accommodating at least a photoconductive element therein and formed with an opening for image transfer via which the photoconductive element is partly exposed to an outside, wherein the opening is an only opening allowing substances harmful to image formation into the case when the image forming unit is mounted to the casing;

an air conditioning device configured to remove the harmful substances flowing into the image forming unit from the outside;

a contact type developing device contacting the photoconductive element at an upstream side of the opening in a direction of rotation of the photoconductive element; and a pair of seal members positioned at opposite ends of the opening in a direction of length configured to seal clearances between the opening and the photoconductive element.

116. An image forming apparatus comprising:

a casing;

an image forming unit comprising a case accommodating at least a photoconductive element therein and formed with an opening for image transfer via which the photoconductive element is partly exposed to an outside, wherein the opening is an only opening allowing substances harmful to image formation into the case when the image forming unit is mounted to the casing;

an air conditioning device configured to remove the harmful substances flowing into the image forming unit from the outside; and a contact type developing device contacting the photoconductive element at an upstream side of the opening in a direction of rotation of the photoconductive element, wherein the air conditioning device is disposed in the image forming unit.

117. An image forming apparatus comprising:

a casing;

an image forming unit comprising a case accommodating at least a photoconductive element therein and formed with an opening for image transfer via which the photoconductive element is partly exposed to an outside, wherein the opening is an only opening allowing substances harmful to image formation into the case when the image forming unit is mounted to the casing;

an air conditioning device configured to remove the harmful substances flowing into the image forming unit from the outside; and a contact type developing device contacting the photoconductive element at an upstream side of the opening in a direction of rotation of the photoconductive element, wherein the air conditioning device accommodates an optical catalyst thereinside.

118. An image forming apparatus comprising:

a casing;

an image forming unit comprising a case accommodating at least a photoconductive element therein and formed with an opening for image transfer via which the photoconductive element is partly exposed to an outside, wherein the opening is an only opening allowing substances harmful to image formation into the case when the image forming unit is mounted to the casing;

an air conditioning device configured to remove the harmful substances flowing into the image forming unit from the outside; and a contact type developing device contacting the photoconductive element at an upstream side of the opening in a direction of rotation of the photoconductive element, wherein the air conditioning device accommodates dehumidifying device thereinside.

119. An image forming apparatus comprising:

a casing;

an image forming unit comprising a case accommodating at least a photoconductive element therein and formed with an opening for image transfer via which the photoconductive element is partly exposed to an outside, wherein the opening is an only opening allowing substances harmful to image formation into the case when the image forming unit is mounted to the casing;

an air conditioning device configured to remove the harmful substances flowing into the image forming unit from the outside; and a contact type developing device contacting the photoconductive element at an upstream side of the opening in a direction of rotation of the photoconductive element, wherein the air conditioning device accommodates an ion adsorbing material thereinside.

120. An image forming apparatus comprising:

a casing;

an image forming unit comprising a case accommodating at least a photoconductive element therein and formed with an opening for image transfer via which the photoconductive element is partly exposed to an outside, wherein the opening is an only opening allowing substances harmful to image formation into the case when the image forming unit is mounted to the casing;

an air conditioning device configured to remove the harmful substances flowing into the image forming unit from the outside;

a contact type cleaning device contacting the photoconductive element at a downstream side of the opening in a direction of rotation of the photoconductive element; and a pair of seal members positioned at opposite ends of the opening in a direction of length configured to seal clearances between the opening and the photoconductive element.

121. An image forming apparatus comprising:

a casing;

an image forming unit comprising a case accommodating at least a photoconductive element therein and formed with an opening for image transfer via which the photoconductive element is partly exposed to an outside, wherein the opening is an only opening allowing substances harmful to image formation into the case when the image forming unit is mounted to the casing;

an air conditioning device configured to remove the harmful substances flowing into the image forming unit from the outside; and a contact type cleaning device contacting the photoconductive element at a downstream side of the opening in a direction of rotation of the photoconductive element, wherein the air conditioning device is disposed in the image forming unit.

122. An image forming apparatus comprising:

a casing;

an image forming unit comprising a case accommodating at least a photoconductive element therein and formed with an opening for image transfer via which the photoconductive element is partly exposed to an outside, wherein the opening is an only opening allowing substances harmful to image formation into the case when the image forming unit is mounted to the casing;

an air conditioning device configured to remove the harmful substances flowing into the image forming unit from the outside; and a pair of seal members positioned at opposite ends of the opening in a direction of length configured to seal clearances between the opening and the photoconductive element.

123. An image forming apparatus comprising:

a casing;

an image forming unit comprising a case accommodating at least a photoconductive element therein and formed with an opening for image transfer via which the photoconductive element is partly exposed to an outside, wherein the opening is an only opening allowing substances harmful to image formation into the case when the image forming unit is mounted to the casing; and an air conditioning device configured to remove the harmful substances flowing into the image forming unit from the outside, wherein the air conditioning device is disposed in the image forming unit.

124. An image forming apparatus comprising:

a casing;

an image forming unit comprising a case accommodating at least a photoconductive element therein and formed with an opening for image transfer via which the photoconductive element is partly exposed to an outside, wherein the opening is an only opening allowing substances harmful to image formation into the case when the image forming unit is mounted to the casing; and an air conditioning device configured to remove the harmful substances flowing into the image forming unit from the outside, wherein the air conditioning device is disposed in the image forming unit.

* * * * *